US005345303A

United States Patent [19]

Hiroi et al.

[11] Patent Number: 5,345,303

[45] Date of Patent: Sep. 6, 1994

[54] SHEET SORTER HAVING ALIGNING MEMBER

[75] Inventors: Masakazu Hiroi, Yokohama; Naho Wakao, Machida, both of Japan

[73] Assignee: Canon Kabushiki Kaisha, Tokyo, Japan

[21] Appl. No.: 762,463

[22] Filed: Sep. 19, 1991

[30] Foreign Application Priority Data

Sep. 29, 1990 [JP] Japan ..... 2-262289

[51] Int. Cl.[5] ..... G03G 21/00

[52] U.S. Cl. ..... 355/323; 271/288; 271/292; 271/294

[58] Field of Search ..... 355/321, 323, 324; 270/37, 53; 271/221, 287, 292, 294, 293, 288

[56] References Cited

U.S. PATENT DOCUMENTS

| | | | |
|---|---|---|---|
| 3,910,568 | 10/1975 | Brown et al. | 271/221 |
| 4,930,761 | 6/1990 | Naito et al. | 270/53 |
| 5,011,130 | 4/1991 | Naito et al. | 271/288 |
| 5,035,412 | 7/1991 | Hiroi et al. | 270/53 |
| 5,099,292 | 3/1992 | Hirose | 271/221 |

FOREIGN PATENT DOCUMENTS

| | | | |
|---|---|---|---|
| 0271371 | 10/1989 | Japan | 271/290 |

*Primary Examiner*—Benjamin R. Fuller
*Assistant Examiner*—John Barlow
*Attorney, Agent, or Firm*—Fitzpatrick, Cella, Harper & Scinto

[57] ABSTRACT

A sheet sorter includes a plurality of bins for receiving sorted sheets, a sheet discharging unit for discharging the sheets to the bins, a shifting unit for raising and lowering the plurality of bins in order to selectively face a bin to the sheet discharging unit, an aligning reference wall for regulating one end portion of a sheet discharged to the bin, and an aligning member for bringing the one side portion of the sheet into contact with the aligning reference wall by pushing the other side portion of the sheet. The sheet sorter further includes a controller for controlling the aligning member so as to vary the timing of alignment start depending on whether operation is during normal sorting wherein the bin receiving the sheet at a position facing the sheet discharging unit rises after receiving the sheet or during reverse sorting wherein the bin receiving the sheet descends.

12 Claims, 34 Drawing Sheets

SHEET SORTER HAVING ALIGNING MEMBER

BACKGROUND OF THE INVENTION

1. Field of the Invention

This invention relates to a sheet sorter, and more particularly, for example, to a sheet post-processing apparatus used in distribution/accumulation and the like of sheet-like members (hereinafter termed a sheet), named copying paper, transfer paper or recording paper, discharged from an image forming apparatus, such as a copier, a printer or any other kind of recording apparatus, and to a sheet sorter for sorting, aligning and stapling the sheet.

2. Description of the Related Art

In general, a conventional sheet sorter having an aligning means includes an aligning reference wall for regulating an end portion of a sheet and a swinging arm for pushing an end of the sheet against the aligning reference wall. It performs alignment of the sheet by sequentially pushing copy sheets discharged from an image forming apparatus against the reference wall.

In some sheet sorters, a means for aligning sheets within bins of the sheet sorter is configured so that a swinging arm is threaded through part of a plurality of bins piled approximately perpendicularly to the plane of the floor, and sheets within all the bins can be aligned by the single swinging arm (the swinging arm threaded through the bins).

In the conventional sheet sorter, however, since alignment of sheets is performed by the arm a predetermined time after the sheets have been discharged into the bins facing a sheet discharge means, mountability of sheets is in some cases reduced according to the movement of the bins in normal sorting or reverse sorting after discharging the sheets.

More specifically, in normal sorting (the bins rise), no particular problem arises even if a sheet is aligned after the bins have shifted up when the number of sheets is small. However, when a large number of sheets are mounted and curling of the sheets is great, even if one end portion of a sheet receiving a pushing force by bins having a reduced interval between bins after the bins have shifted up is pushed by an aligning member, the other end portion of the sheet cannot be exactly aligned with the aligning reference wall, causing insufficient alignment of the sheets, or producing pressed marks, scars or the like on a pressed portion of the sheet, thus deteriorating quality of a copy.

In reverse sorting (the bins shift down), if a sheet is aligned by the aligning member and the bundle of copies (the bundle of sheets) are pushed by the aligning member and the aligning reference wall when the bins shift down, a pushing force is applied upon the bundle of copies, and the sheet might stop by the pressure of the aligning reference wall and the aligning member.

SUMMARY OF THE INVENTION

The present invention has been made in consideration of the above-described problems in the conventional apparatus.

It is an object of the present invention to provide a sheet sorter which performs alignment of a plurality of sheets received in a plurality of bins with accuracy.

Referring, for example, to FIGS. 1, 9(*a*)–9(*d*) and 16, the above-described object is accomplished, according to one aspect of the present invention, by a sheet sorter comprising a plurality of bins for sorting and receiving sheets, sheet discharging means for discharging sheets to the bins, shifting means for raising and lowering the plurality of bins in order to selectively align an opening of one bin with the sheet discharge means, and aligning means for aligning the sheets received in the bins, the aligning means comprising an aligning reference wall for regulating one side portion of the sheet and an aligning member for pushing the one side portion of the sheet against the aligning reference wall by pushing the other side portion of the sheet, wherein a control means variably controls sheet-aligning at one timing by the aligning member in normal sorting where a bin for receiving the sheet at a position facing the sheet discharging means rises after receiving the sheet, and at a second sheet during reverse sorting where the bin descends after receiving the sheet.

That is, during normal sorting by the bins, the aligning member completes the operation of pushing the discharged sheet against the aligning reference wall before the bin receiving the sheet completes to shift up. During reverse sorting by the bins, the aligning member pushes the sheet against the aligning reference wall after the bins receiving the sheet has completed to shift down.

According to the above-described configuration, the sheet discharged by the sheet discharging means is received in the bin facing the sheet discharging means, and the sheet after being received is aligned by the aligning member. The aligning operation of the sheet by the aligning member is performed with a different aligning timing in accordance with the normal sorting operation or the reverse sorting operation by the bins.

In normal sorting, alignment of the sheet is completed at a time period earlier than when the bin in which the sheet is discharged shifts up and an interval between bins is narrowed.

In reverse sorting, alignment of the sheet by the aligning member is performed after the bin in which the sheet has been discharged has completed to shift down, whereby alignment of a plurality of sheets within the bin is performed with a high accuracy.

As explained above, according to the present invention, since a sheet-aligning timing by the aligning member is variable in accordance with the movement of the bin in which the sheet is discharged in normal-sorting or reverse-sorting, alignment of the sheet can be properly performed irrespective of the direction of the movement of the bins.

Furthermore, since alignment of the sheet is performed before the bin in which the sheet has been discharged completes to shift up in normal sorting, and after the bin has completed to shift down in reverse sorting, a plurality of sheets can be received/aligned within a plurality of stages of bins with a high accuracy even in a high-speed apparatus wherein a time interval between discharged sheets is small.

DETAILED DESCRIPTION OF THE PREFERRED EMBODIMENTS

A first embodiment of the present invention will now be explained with reference to the drawings.

Figure 1:
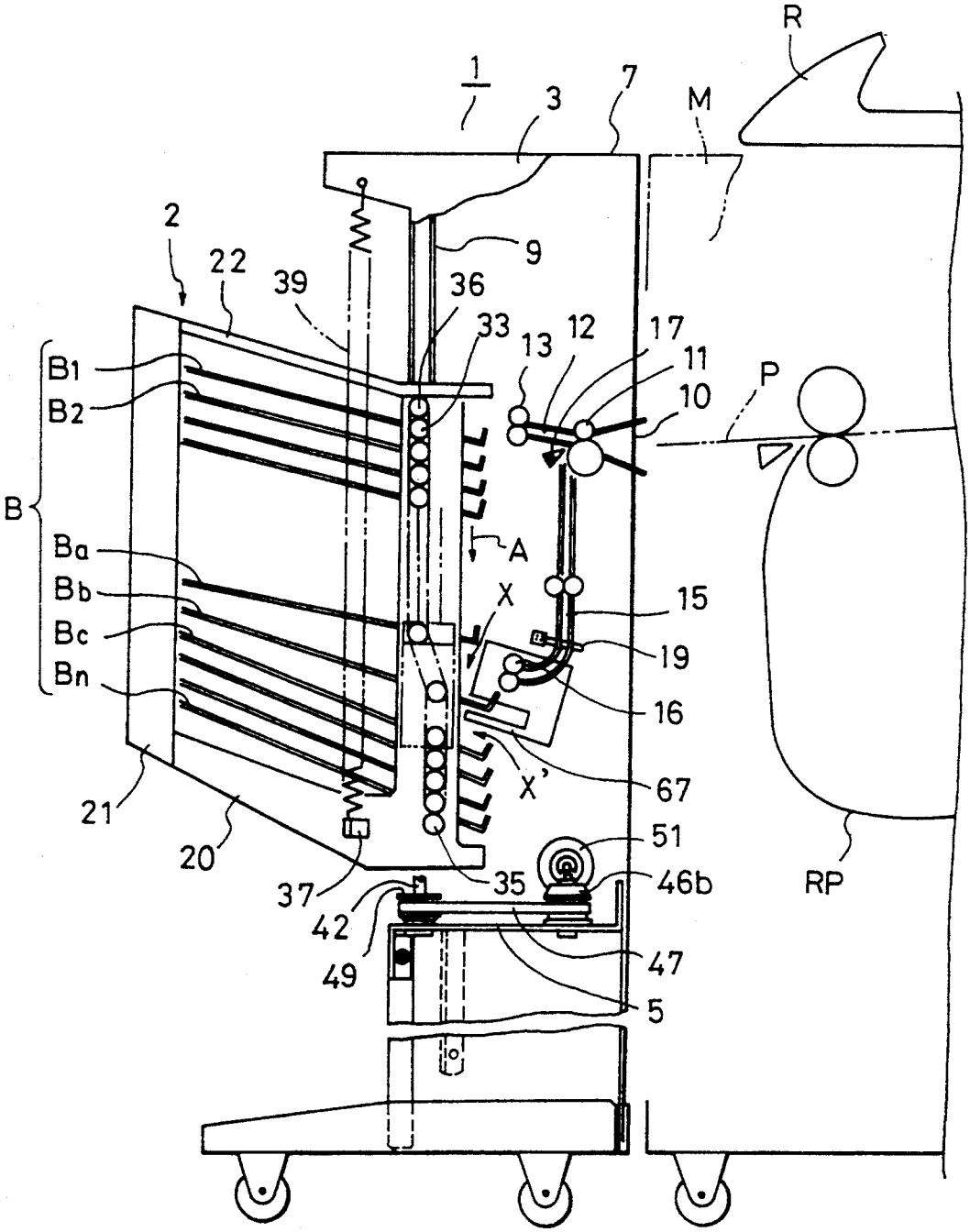
FIG. 1 is a sectional side view of a sheet postprocessor according to an embodiment of the present invention.
Figure 3:
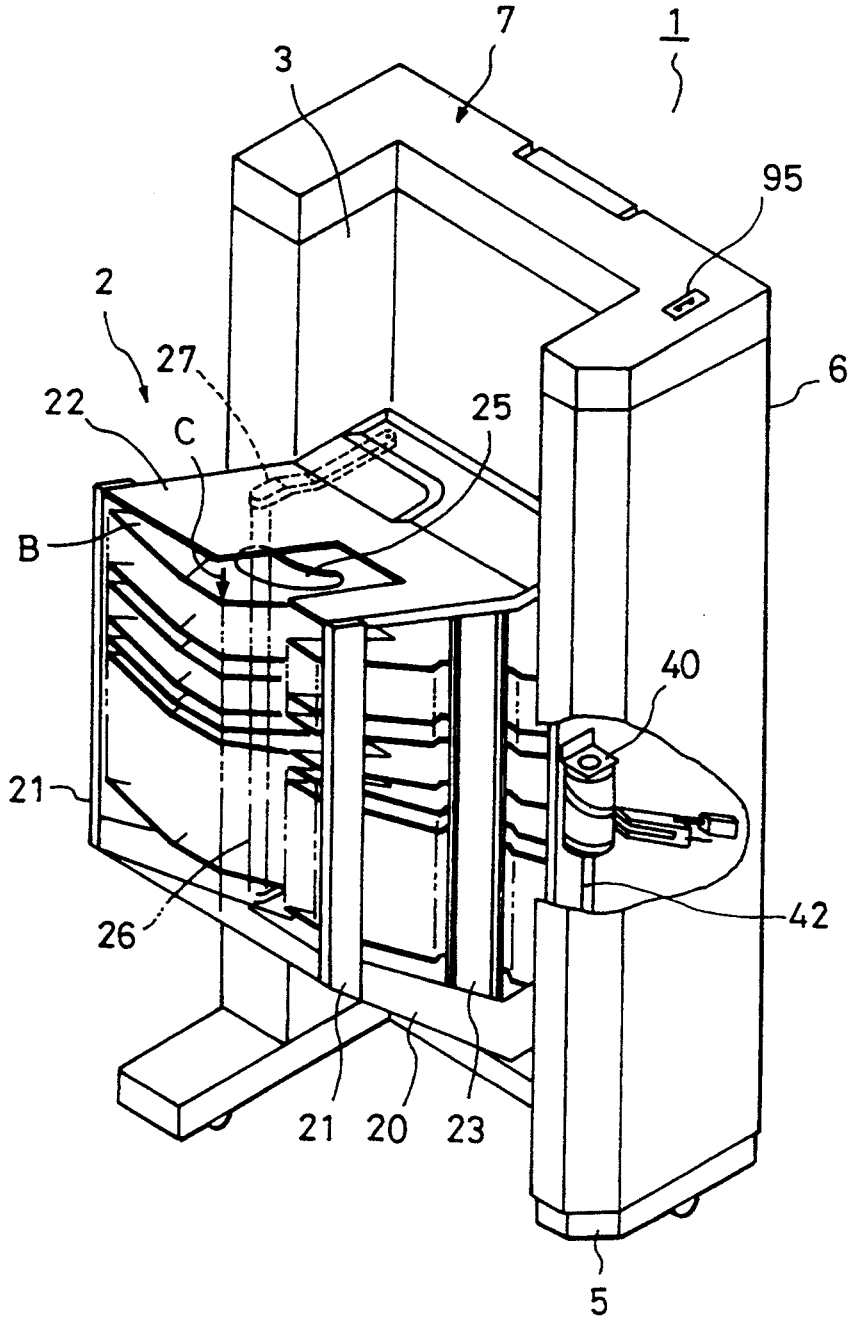
FIG. 3 is a perspective view of the sheet postprocessor.

In FIGS. 1 and 3, a bin-moving-type sorter (sheet postprocessor) 1 includes a main body 7 of the sorter comprising a pair of right and left side plates 3, a base 5, and a cover 6. The sorter 1 receives a group of bins B comprising bins $B_1$–$B_n$, and includes a bin unit 2 movable upward and downward along a pair of guide rails 9 provided at the respective side plates 3.

The main body 7 of the sorter is connected to an image forming apparatus M disposed at a side upstream from the main body 7 (the right side in FIG. 1), and includes a carrying inlet 10 and a pair of carrying rollers 11 for carrying a sheet P discharged from the image forming apparatus M. In this embodiment, image forming apparatus M comprises an original feeder R, fixing rollers, a refeed path RP, a photosensitive drum and the like. A first sheet-conveying path 12 and a pair of upper discharging rollers 13 are provided in sequence moving from the pair of carrying rollers 11 toward bin unit 2. Also provided is downwardly-directed second sheet-conveying path 15 branching from the pair of carrying rollers 11, and a pair of lower discharging rollers (sheet-discharging means) 16 facing the bin unit 2. A deflector 17 is disposed at a branching portion of the above-described two sheet conveying-paths 12 and 15. The deflector 17 is selectively displaced so as to guide a sheet to be discharged into one of bins B by tile pair of upper discharging rollers 13 to the first sheet-conveying path 12 and to guide a sheet to be discharged into one of bins B from the pair of lower discharging rollers 16 to the second sheet-conveying path 15.

A paper sensor 19 for detecting passage of sheet P is disposed near a sheet-discharging portion of the second sheet-conveying path 15. Although, in the present embodiment, the paper sensor 19 comprises a lead switch incorporating a photo-interrupter, a transmission-type sensor may also provide the same function. The sheet P discharged from an image forming unit of the image forming apparatus M has been detected by a discharge sensor disposed within the image forming apparatus M. In the present embodiment, both the passing time of the sheet P and the interval (between paper) between each successive sheet P can be measured. A calculation circuit incorporated within the main body of the image forming apparatus issues a discharge signal at the passing time of sheet P and an interval-between-paper signal of the sheet P, and these signals are transmitted to a microcomputer provided within the bin unit 2.

Figure 4:
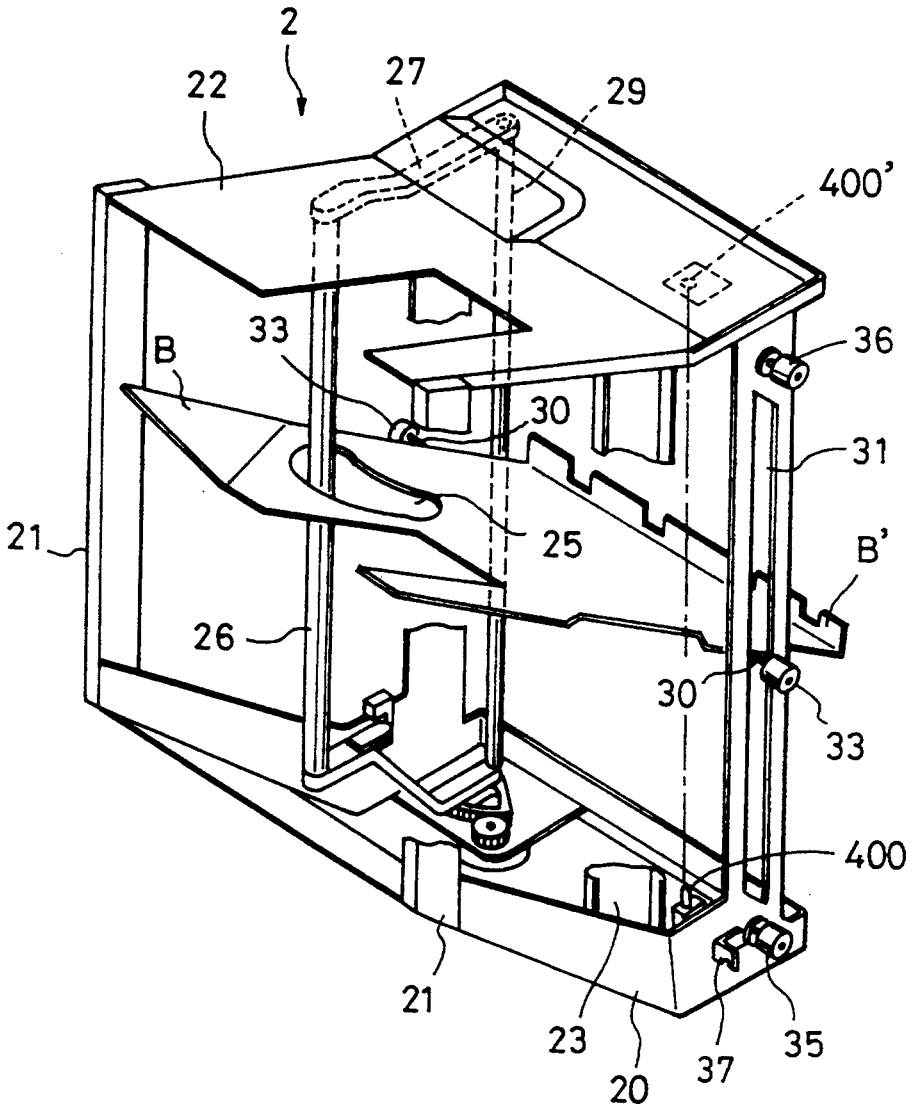
FIG. 4 is a perspective view of a bin unit.

As shown in FIG. 3 or 4, the bin unit 2 includes a pair of bin-supporting plates 20 having a frame structure at front and rear portions of the bin unit 2. A bin slider 21 is mounted on a front end of each bin-supporting plate 20. A bin cover 22 is fixed on the bin-supporting plates 20 and the bin sliders 21. An aligning reference wall 23 is fixed between the bin cover 22 and the bin-supporting plates 20. An aligning bar 26 is threaded through notches 25 provided in each bin B so as to extend through the entirety of bins B. The aligning bar 26 is swingable around a center bar 29 pivoting aligning bar 26 via a pair of aligning arms 27 connected at the upper and lower portions of the aligning bar 26. The sheet P received in each bin B is aligned by being pushed against the aligning reference wall 23 by a swinging operation of the aligning bar 26.

Figure 5:
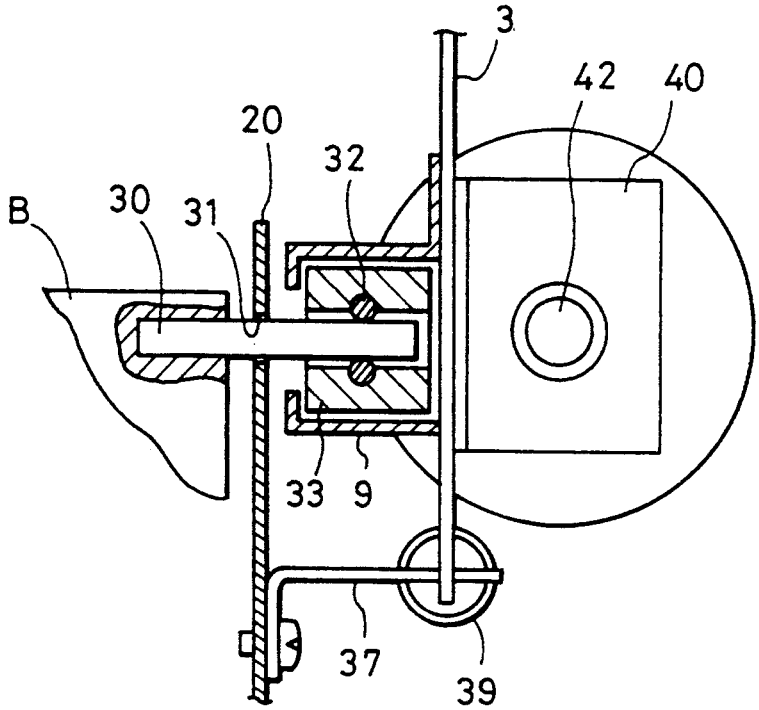
FIG. 5 is a sectional plan view of a lead cam/trunnion unit.

Two free-end portions of each bin B received in the bin unit 2 are movably mounted on comb-teeth-like grooves (not shown) in the bin sliders 21. As shown in detail in FIG. 5, pins 30 are fixed to the right and left sides of base-end portions of the bins B. The pins 30 are threaded through slits 31 provided in the right and left bin-supporting plates 20. Trunnions 33 are rotatably mounted on outer ends of the pins 30 via O rings 32, serving as shock absorbers.

The trunnions 33 are fit in the guide rails 9 so that the trunnions 33 of the respective bins B are piled up. The lowermost trunnions 33 contact lower guide rollers 35 rotatably supported at the bin-supporting plates 20, and the uppermost trunnions 33 contact the upper guide rollers 36 rotatably supported at the bin-supporting plates 20. The respective bins B are supported in the bin unit 2 so that the spacing between bins is maintained constant and equal to the outer diameter of the trunnion 33.

As shown in FIG. 1, the bin unit 2 is configured to be able to rise and descend along the guide rails 9 with the upper guide rollers 36 and the lower guide rollers 35 fitted in the guide rails 9. Tension springs 39 are stretched between metal fittings 37 fixed on the bin unit 2 and the side plates 3 so as to upwardly pull the bin unit 2 by the elastic force of the tension springs 39.

Figure 6:
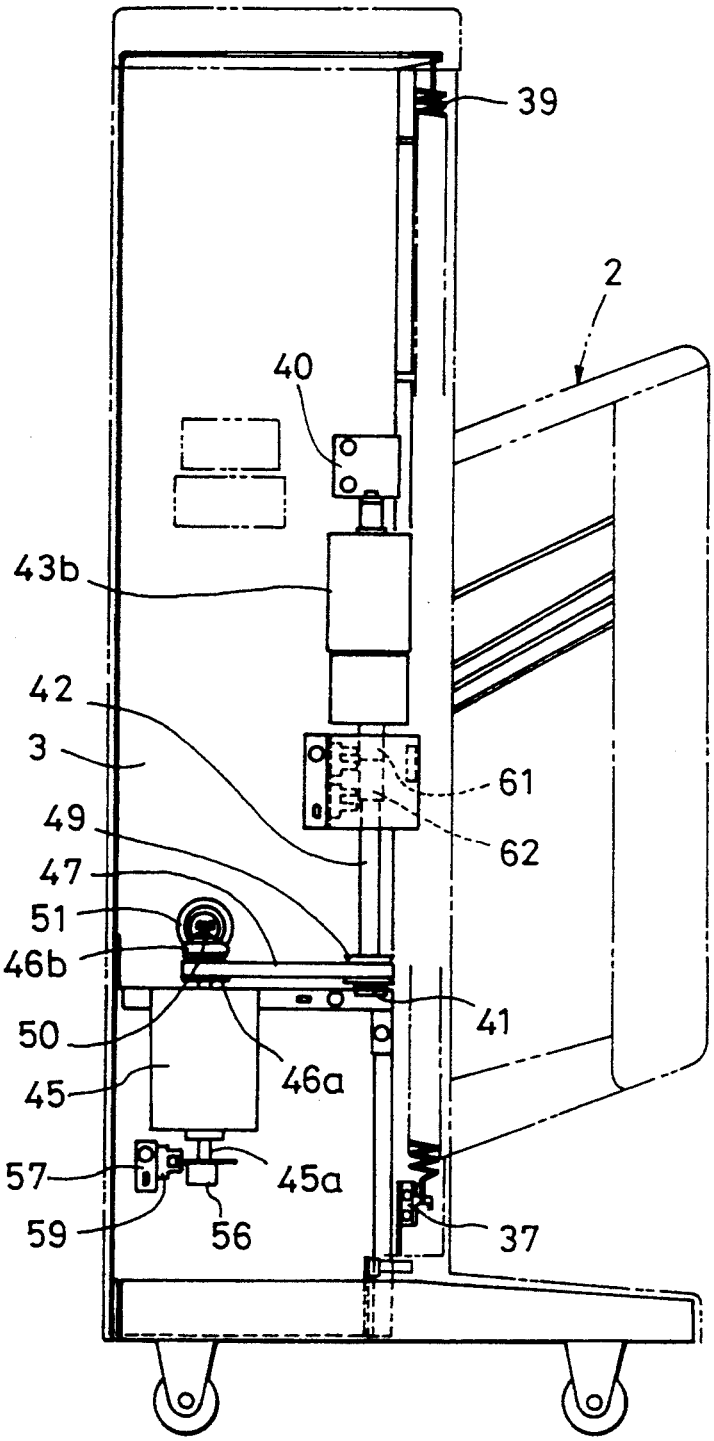
FIG. 6 is a sectional side view of the apparatus shown in FIG. 1 as seen from the opposite side.

As shown in FIGS. 3 and 6, cam-shaft holders 40 are disposed at positions facing the pair of lower discharging rollers 16 supported at the right and left side plates 3, and lead-cam shafts 42 are rotatably disposed between the cam-shaft holders 40 and the base plate 5 via bearings 41. A pair of right and left lead cams (spiral cam means) 43a and 43b provided with spiral cam surfaces are fixed at upper portions of the right and left lead-cam shafts 42 (see FIG. 10).

Figure 10:
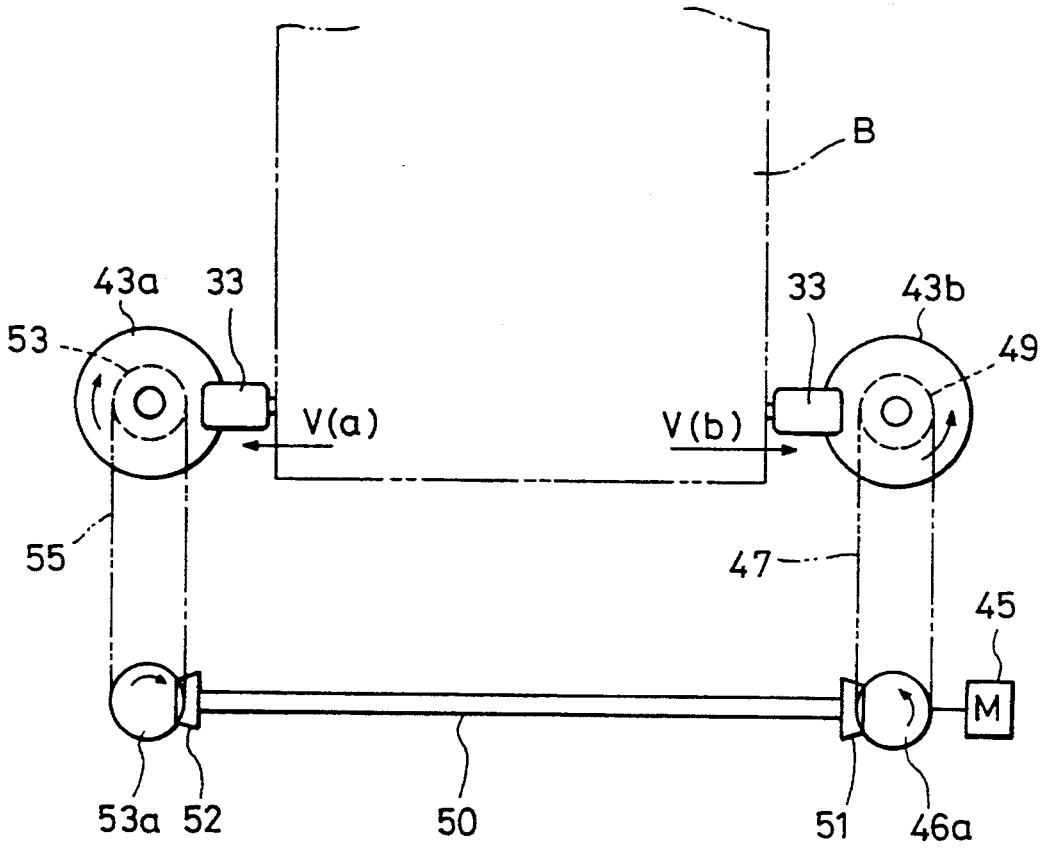
FIG. 10 is a plan view of a driving system for the lead cams.

In FIGS. 6 and 10, a shift motor 45 rotatable in forward and reverse directions is fixed at one of the side plates 3, and a bevel gear 46b integral with a pulley 46a is fixed at one end of an output shaft 45a of the shift motor 45. The pulley 46a is connected to a pulley 49 fixed on the lead-cam shaft 42 of the lead cam 43b via a belt 47. A bevel gear 51 fixed on one end of a through shaft 50 meshes with the bevel gear 46b, and bevel gear (not shown) integral with a pulley 53 meshes with a bevel gear 52 fixed on the other end of the through shaft 50. As shown in FIG. 10, the pulley 53 is connected to a pulley 53 fixed on the lead-cam shaft 42 of the other lead cam 43a via a belt 55. According to the drive transmission system configured as described above, when the shift motor 45 rotates in the forward or reverse direction, the lead cams 43a and 43b rotate in the directions shown by the arrows in FIG. 10, or in directions reverse to these directions.

A clock disk 56 is fixed on the other end (the lower end in FIG. 6) of the output shaft 45a of the shift motor 45. An interrupter 59 held on one of the side plates 3 by a sensor holder 57 can read the number of revolutions of the shift motor 45, that is, the number of revolutions of the lead cams 43a and 43b. A lead cam control circuit within a microcomputer provided in the sorter 1 can arbitrarily control the number of revolution of the lead cams 43a and 43b.

Figure 7:
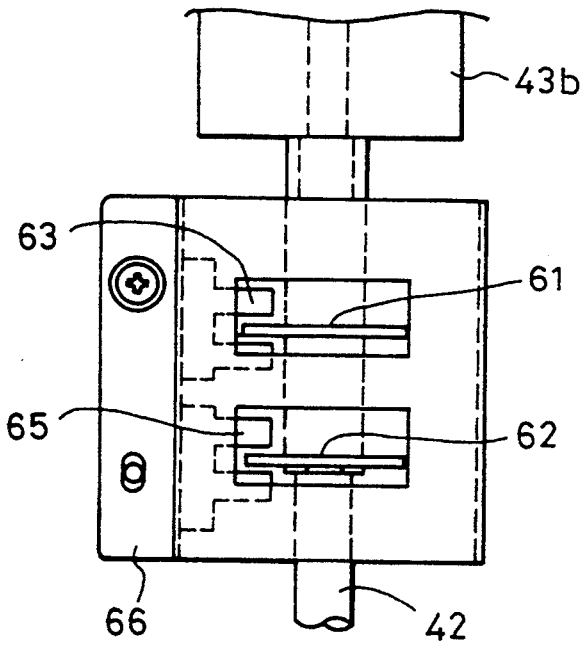
FIG. 7 is a side view of a flag portion of the lead cam.
Figure 8:
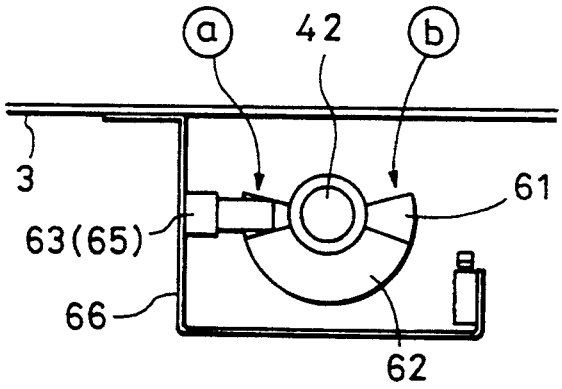
FIG. 8 is a plan view of the flag portion of the lead cam.
Figure 9A:
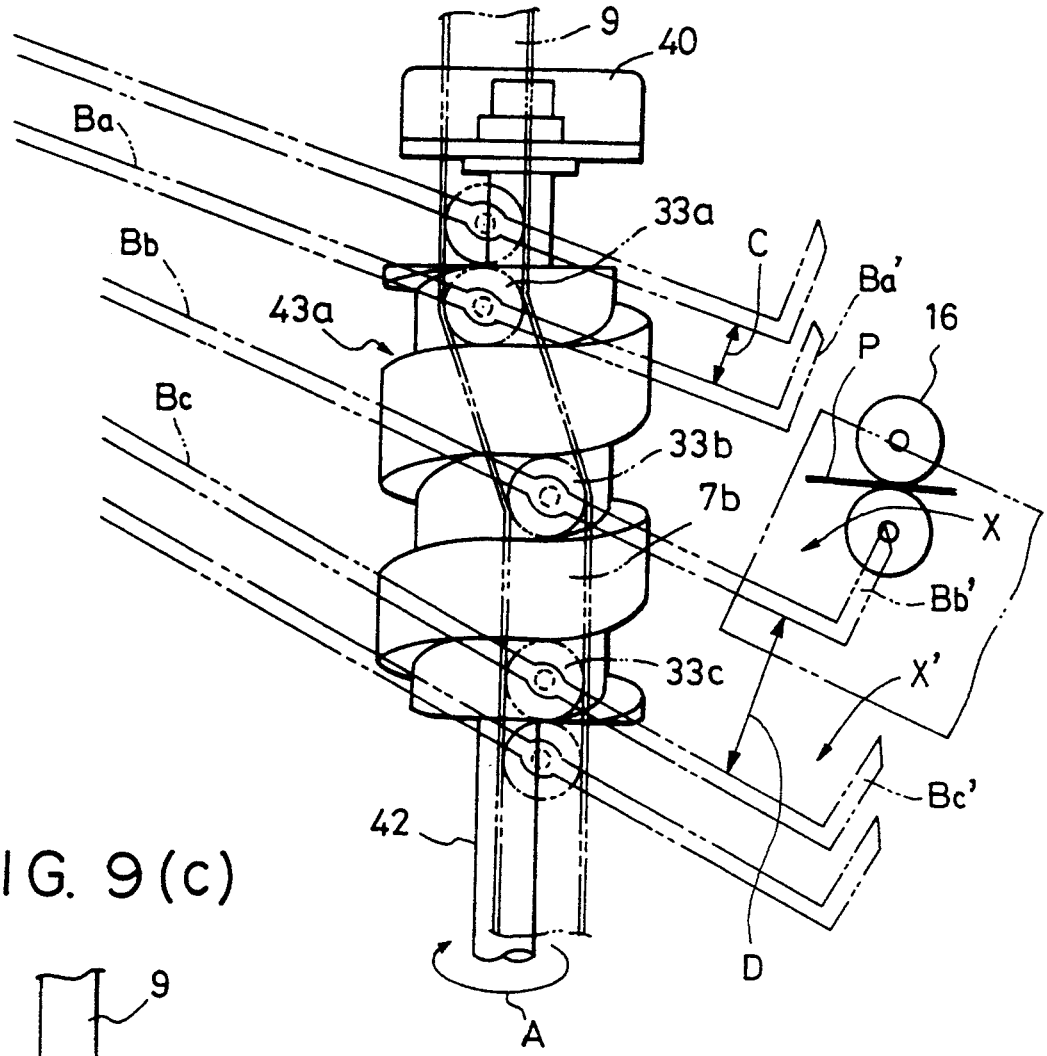
FIGS. 9(*a*)–9(*d*) are side views showing the relationship between lead cams and bins.
Figure 9C:
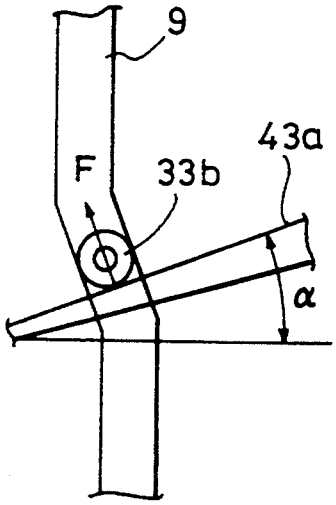
Figure 9B:
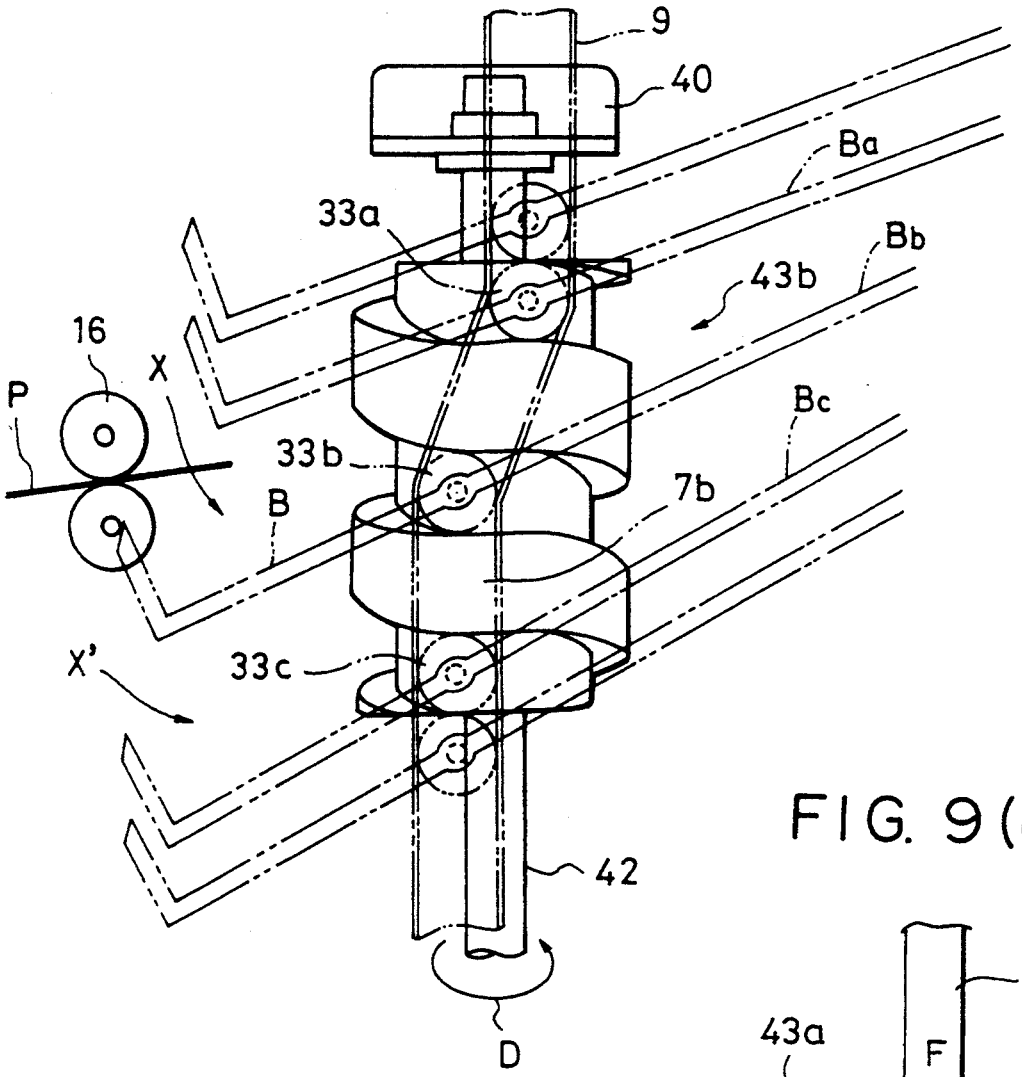
Figure 9D:
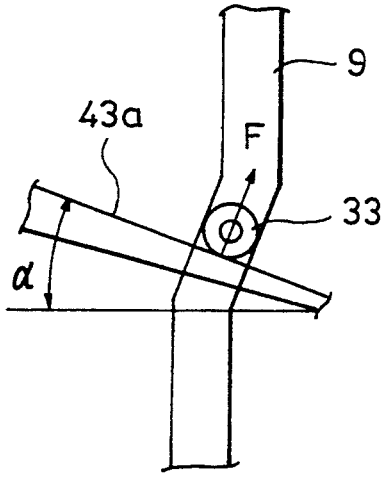

As shown in FIG. 6, a pair of flags 61 and 62 for detecting the positions of the lead cams 43a and 43b are coaxially fixed below the lead cam 43b on the lead cam shaft 42. FIGS. 7 and 8 are enlarged views of the pair of flags 61 and 62. In FIGS. 7 and 8, interrupters 63 and 65 for reading the flags 61 and 62 are held by a holder 66 fixed on the side plate 3.

The interrupters 63 and 65 are arranged so as to have the same flag angle with respective phases shifted by a predetermined amount. By on/off states of the two interrupters 63 and 65 due to the shift in phases, it is determined whether the bins B are in home positions in the rising direction or in home positions in the descending direction, as will be described later.

The lead cams 43a and 43b include parallel portions (about 180°), as will be described later. The phase shift between the flags 61 and 62 is determined in accordance with the parallel portions. The phases of the flags 61 and 62 are shifted by a predetermined angle (about 30°). By the on/off states of the interrupters 63 and 65 due to the shift of angles between the flags 61 and 62, the positions of the lead cams 43a and 43b are determined.

Next, an explanation will be provided of the operation of the bins B determined by the shapes of the lead cams 43a and 43b, and the trunnions (bin rollers) 33 engaged with the lead cams 43a and 43b.

FIG. 9(*a*) illustrates the relationship among the left-side lead cam 43a, the trunnions 33 and the bins B. FIG. 9(*b*) illustrates the relationship between the right-side lead cam 43b and the trunnions 33. FIG. 10 is a plan view of a drive transmission system for the lead cams 43a and 43b.

As shown in FIGS. 9(*a*)–9(*d*) and 10, in the present embodiment, directions of respective screws of the lead cams 43a and 43b are reverse so as to provide reverse directions of rotation, and the lead cams 43a and 43b are mirror-symmetrical with each other. In the present embodiment, a two-way-type configuration is adopted so that the spacing between bins B can be expanded at two expanding portions X and X'. This is to allow a sheet stapling mechanism to enter and retract from the bin B. If only the sorting function is needed, only the expanding portion X in which the sheet P is conveyed is required as the expanding portion.

When the lead cams 43a and 43b rotate in the directions of the arrows or in directions reverse to those directions by the drive of the shift motor 45, the trunnions 33 are pushed within grooves in the lead cams 43a and 43b, and rise or descend guided by the guide rails 9. A deflected portion is provided in part of each of the guide rails 9 shown in FIGS. 9(*a*)–9(*d*) in order to displace the bins B in the back-and-forth direction (the moving direction of the sheet) because the sorter 1 in the present embodiment includes the sheet stapling mechanism 67. However, the present invention is not limited to this configuration.

Figure 11:
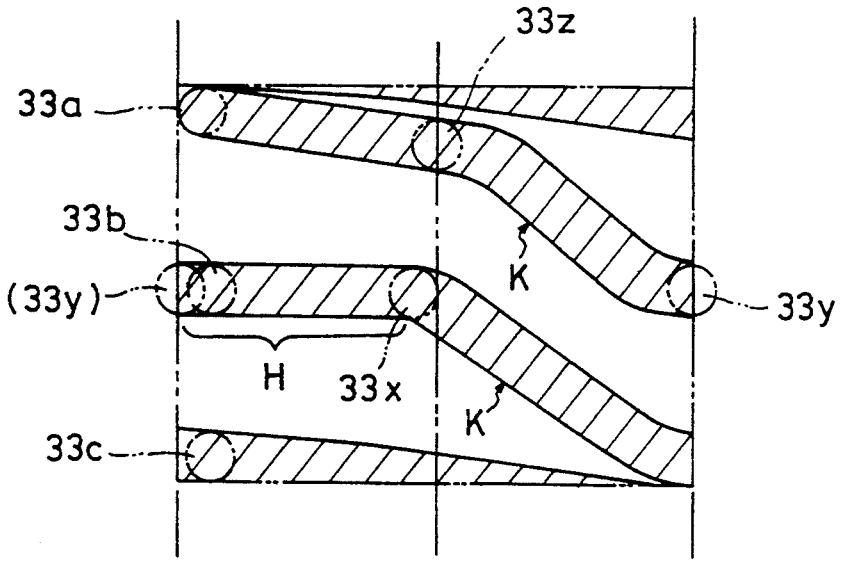
FIG. 11 is a cam diagram of the lead cams.

FIG. 11 illustrates a cam diagram of the lead cam 43a in the present embodiment. In FIG. 11, hatched portions represent cam grooves in the lead cam 43a. The cam diagram for the left side (the left side in the moving direction of the sheet P) is shown. A cam diagram of the other lead cam 43b is mirror-symmetrical with this diagram. Since the above-described cam diagram represents a range of 0°–360° and is a cam diagram in the present embodiment, a cam diagram for two bins is shown.

The positions of the trunnions 33 within the grooves of the lead cam 43a are represented by reference numerals 33a, 33b and 33c. A portion represented by symbol H in FIG. 11 is a nearly-parallel portion of the lead cam 43a. A parallel portion of about 180° is set in the present embodiment. In the above-described cam diagram, if the lead cam 43a moves to the right, that is, if the lead cam 43a rotates clockwise as in the direction of the arrow in FIG. 10 (the trunnions 33 perform relative movement to the left in FIG. 11), the bins B rise. On the other hand, if the lead cam 43a rotates counterclockwise (the trunnions perform relative movement to the right), the bins B descend. The above-described parallel portion H indicates the sheet discharging position of the lead cam 43a, and inclined portions K indicate shift positions.

When the sheet P in FIG. 1 is discharged from the pair of lower discharging rollers 16, the system is set so that a horizontal state (the parallel portion H) is provided relative to the moving direction of the lead cam 43a. Hence, reference numeral 33x represents the home position when the trunnions 33 rise, and reference numeral 33y represents the home position when the trunnions 33 descend. In the present embodiment, the phases of the home positions 33x and 33y are shifted by 180°, as shown in FIG. 11. The positions 33x and 33y in the lead cam 43a correspond to flag regions (a) and (b) shown in FIG. 8.

In the present embodiment, if an angle made by one circumference of the lead cam 43 (43a and 43b) is represented by 2 $\pi$(rad), an angle made by the parallel portion H is represented by $\theta$ (rad), and a time during which the sheet P passes through the pair of lower discharging rollers 16 is represented by $t_1$, the number $R_1$ (rpm) of revolutions of the lead cam 43 can be expressed by the following expression (1):

$$R_1 = 60\theta / 2\pi t_1 \quad (1).$$

Accordingly, the number of revolutions (the process speed) of the lead cam 43 increases as the discharging time of the sheet P becomes shorter.

If the time interval between passage of sheets P when the sheets P are being continuously discharged from the image forming apparatus is represented by $t_2$, in order to adjust one revolution of the lead cam 43 with the discharging time of the sheet P+the time interval between paper, the number $R_2$ (rpm) of revolution of the lead cam 43 in the remaining angle $(2\pi-\theta)$ (corresponding to the inclined portion of the lead cam 43*a*) must be:

$$R_2=60(2\pi-\theta)/2\pi t_2 \quad (2).$$

If the angle $\theta$ made by the parallel portion H of the lead cam 43 is set so that $R_1=R_2$, the revolution speed of the lead cam 43 becomes theoretically constant during the discharging time of the sheet and the time interval between paper, and it becomes therefore possible to shift the bins B while receiving the sheet P in the bin B with rotating the lead cam 43. That is, it is possible to achieve a sheet sorting function for the sheets P discharged from the image forming apparatus in a state wherein the lead cam 43 rotates at a constant speed.

When the image forming apparatus is a high-speed machine, in particular, the value $t_2$ is reduced. Hence, even if the number of revolutions of the lead cam 43 is not constant, the lead cam 43 never stops, though its number of revolutions may change, if a two-stage speed control from $R_1$ to $R_2$ is performed. Thus, the sound typically generated by an impulsive force corresponding to inertia of the bin unit accompanying the rotation and stop of the lead cam in a bin-moving-type sorter of this kind is not generated in the present embodiment. Hence, it becomes possible to design a quieter sorter.

Another feature of the present embodiment is that the sorter of the present embodiment is suitable for a high-speed (high-productivity) copier. That is, if the set angle $\theta$ for the horizontal portion H of the lead cam 43 is more or less changed (for example, at least 180°), the angle of revolution of the lead cam 43 during the interval between paper is proportionally reduced. Hence, even if the speed of revolution of the lead cam 43 is considerably reduced, the sorter can be used for a machine having higher speed (higher productivity) than a conventional copier.

Furthermore, since the on/off control (moving and stopping operation) of a large unit such as the bin unit 2 is not performed, loss in the power consumption of the copier can be reduced.

Figure 31:
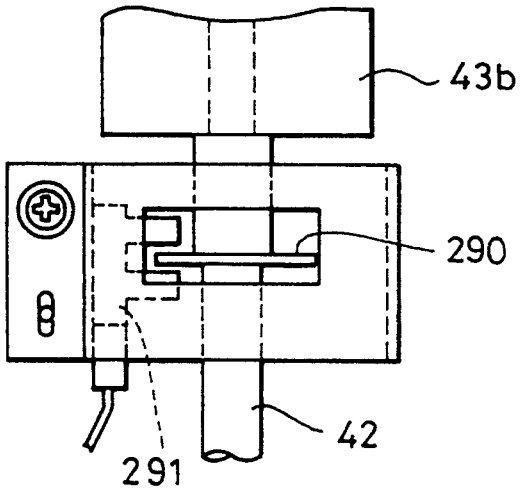
FIG. 31 is a side view showing a modified example of a lead-cam detecting unit.
Figure 32:
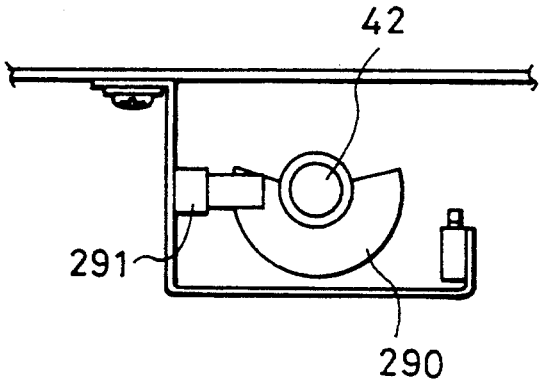
FIG. 32 is a plan view of the lead-cam detecting unit.

In the present embodiment, an explanation has been provided of a configuration having two lead-cam flags 61 and 62. However, for example, as shown in FIGS. 31 and 32, the same effect may be obtained even if a single flag 290 and a single interrupter 291 are provided adjusted to the parallel portions of the lead cams 43*a* and 43*b*.

In this case, determination whether the bins B are at the home positions for rise or descent is possible if data are stored in a microcomputer (not shown) after the completion of the operation. If the power supply is turned off and position information of the lead cams 43*a* and 43*b* is cleared, by slightly rotating (initializing) the lead cams 43*a* and 43*b* and recognizing whether an interrupter 301 is from an on-state to an off-state or remains in an on-state, the positions of the lead cams 43*a* and 43*b* can be determined. At that time, if a position detecting sensor for the bin unit 2 is in a on-state, it is also possible to determine whether or not the positions of the lead cams 43*a* and 43*b* correspond to the home position of the bin unit 2.

A detailed explanation will now be provided of a stapler (a sheet-stapling mechanism) in the present embodiment.

Figure 2:
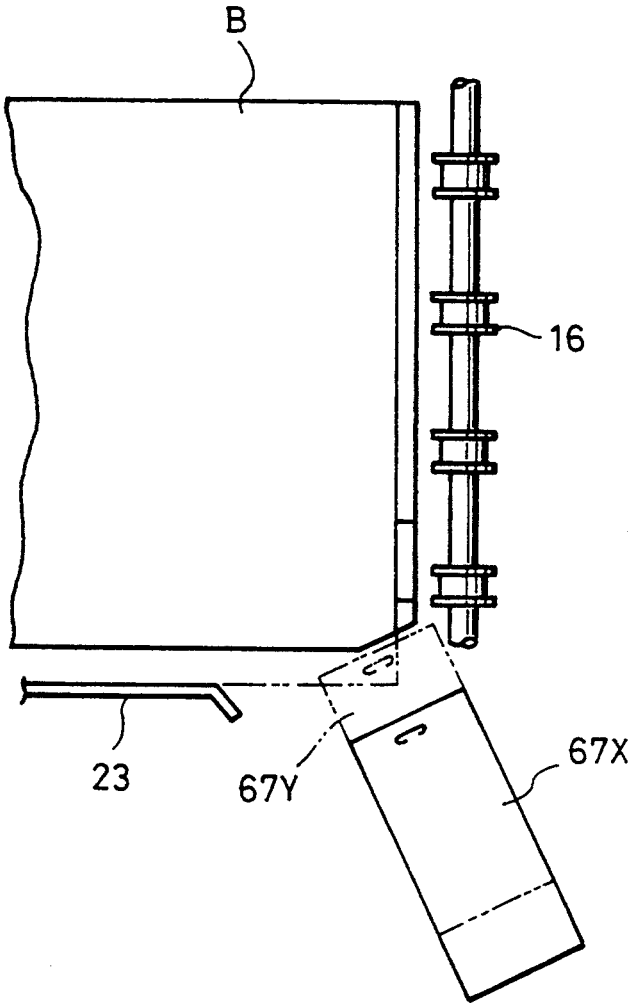
FIG. 2 is a view of the sheet postprocessor as seen from the direction of arrow A shown in FIG. 1.
Figure 12:
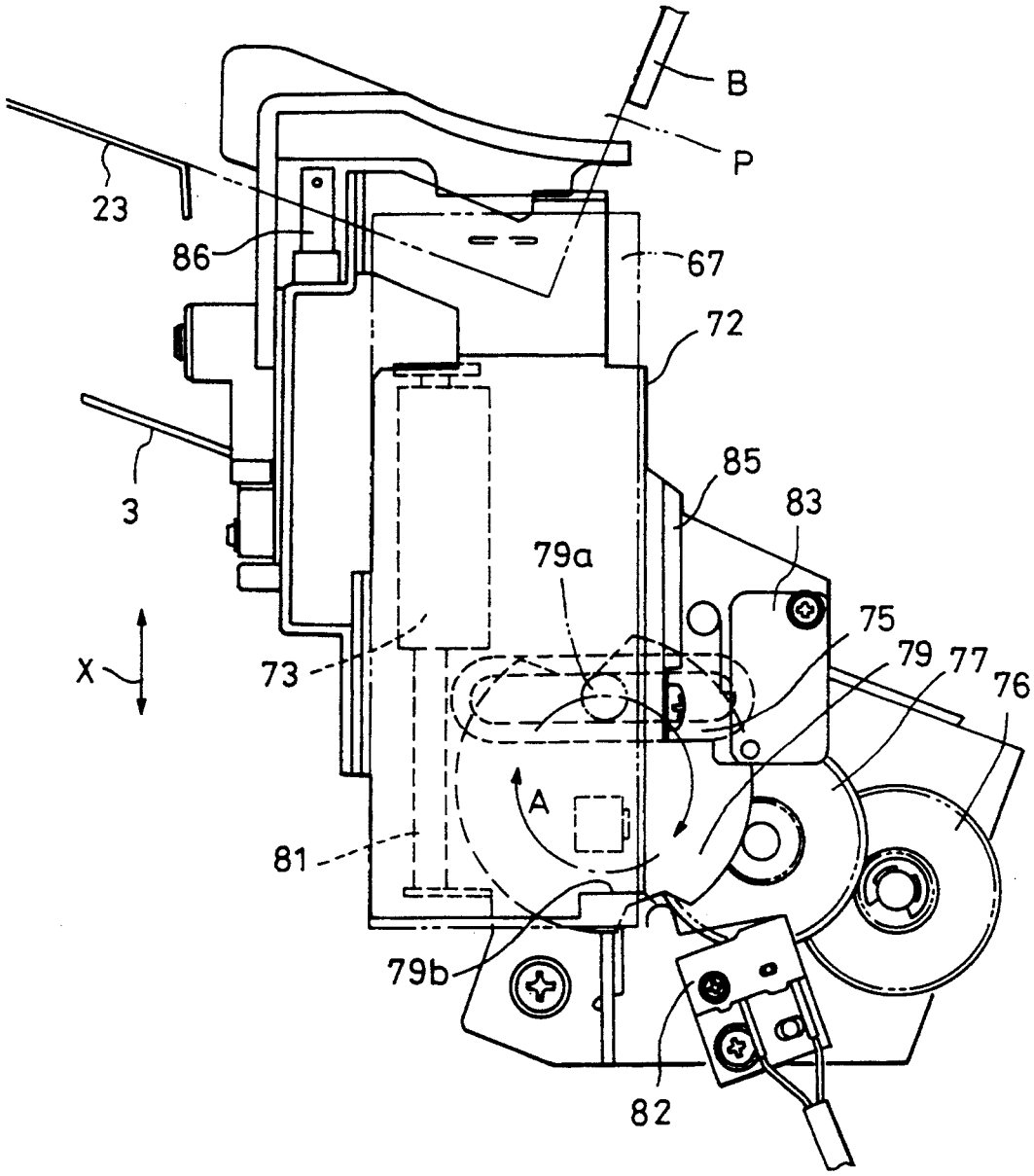
FIG. 12 is a plan view of a stapling unit.

FIG. 2 illustrates the position of stapler 67 as seen from above. The sheet-stapling mechanism 67 is configured so as to be able to advance within and retract from the bin B of the sorter 1. FIGS. 12, 13(*a*) and 13(*b*) illustrate the configuration in more detail.

The stapler 67 indicated by two-dot chain lines in FIGS. 12 and 13(*a*) is a conventional electrically-driven stapler, and comprises a staple-cartridge unit 69 capable of receiving a large number of staples, a staple-feeding unit 67*a* for sequentially feeding staples N from the staple-cartridge unit 69 to a stapling unit 67*b*, and the stapling unit 67*b* for stapling the sheet P or the like using a fed staple to perform a stapling operation.

The stapling unit 67*b* includes a center 67*c* of rotation, and a stapling operation is performed while an upper unit (movable in the directions Y in FIG. 13(*a*)) and a lower unit of the stapler 67 sandwich the sheets P. A stapler cover 70 for covering a motor and a driving system (not shown) is screwed on a stapler attachment plate 71, which fixedly attaches the main body of the stapler 67.

The stapler attachment plate 71 is fixedly screwed on a moving platform 72 for reciprocating the stapler 67. A moving guide 73 and a roller slider 75 are fixed on a lower portion of the moving platform 72. A driving force from a stapler driving motor (not shown) is transmitted to a link gear 79 via gears 76 and 77. The link gear 79 includes a projection 79*a* engaged with the roller slider 75, and is configured so as to rotate in the direction A in FIG. 12.

The link gear 79 includes two microswitch actuating portions facing each other. Since the projection 79*a* rotates 180° for every half-rotation of the link gear 79, the roller slider 75 can move a distance corresponding to a rotation diameter of the projection 79*a* of the link gear 79. The moving guide 73 engages a guide shaft 81 mounted on a stapler-fixing plate 80, and can move the moving platform 72 mounting the stapler 67 in parallel in cooperation with the link gear 79.

A rotation-detecting microswitch 82 detects every half-rotation of the link gear 79. A stapling-unit-position-detecting microswitch 83 engages a cam 85 mounted on a side surface of the moving platform 72, and is configured so as to be switched off when the stapling unit is at a retracted position 67X retracted from the bin B, and switched on at other times.

A transmission-type paper sensor having a z-like shape and capable of sensing the sheet P using upper and lower projections is provided at one end portion of the moving platform 72, and is configured so as to be able to detect the sheet P when the stapling unit reaches sheet-stapling position 67Y. The above-described stapling unit and a unit capable of reciprocating the stapling unit are fixed on the side plate 3.

A front-end side for receiving the sheet of a tapered guide 87 is tapered so as not to turn up or shift the front end of the sheet P when the stapling unit advances onto the sheet P (the sheet-stapling position 67Y). The tapered-guide 87 is rotatable around an axis 87*a* of rotation, and a rear-end portion 87*b* of the tapered-guide 87 is usually driven in a counterclockwise direction by a spring means (not shown) so as to actuate a stapler safety microswitch 89.

When, for example, the stapling unit advances onto the sheet P (the sheet-stapling position 67Y), if a foreign substance (for example, a hand of the operator) is placed on the bin or the stack of sheets P are thicker than the stapling capability of the stapler 67, a moment raising the front-end portion of the upper portion of the tapered guide 87 is produced within the bin B and, with the lower unit portion 90 of the tapered guide 87 being fixed, the upper portion of the tapered guide 87 rotates in a clockwise direction around the axis 87*a* of rotation, whereby the safety microswitch 89 is switched off to mechanically cut off current supply for the stapler 67.

An interlocking arm 91 having an axis 91*a* of rotation is provided on an upper portion of the stapler cover 70. The interlocking arm 91 is usually driven so as to rotate in a counterclockwise direction by a spring means (not shown).

An actuating plate 92 provided on the side plate 3 is disposed above the interlocking arm 91. In accordance with the reciprocating movement of the stapling unit in the direction X shown in FIG. 13(*a*), the interlocking arm 91 is situated at a position indicated by solid lines when the stapling unit is at the sheet-stapling position 67Y, and the interlocking arm 91 contacts the front-end portion of the actuating plate 92 when the stapling unit is at the retracted position 67X, whereby, as shown by reference numeral 91X, the lower portion of the interlocking arm 91 rotates over the upper portion of the staple-cartridge unit 69 of the stapler 67 to depress the staple-cartridge unit 69.

Next, an explanation will be provided of detection of staples in the stapler 67.

In FIG. 13(*a*), there is shown a reflection-type staple sensor 93 indicated by two-dot chain lines. When the last staple of staples provided in the form of a sheet passes through the reflection-type staple sensor 93, the sensor 93 detects the absence of staples. At that time, some staples in the form of a sheet still remain downstream of sensor 93, and the front end of the sheets to be stapled is held inside the stapler 67. When the absence of staples has been detected, a manual stapling button 95 is flashed, or a message indicating the absence of staples is displayed on a display unit (not shown) of the image forming apparatus to urge the user to exchange the staple cartridge. In the present embodiment, the system is configured so that a stapling operation is prohibited when the reflection-type staple sensor 93 has detected the absence of staples. Although the absence of staples generally indicates that no staple N is present within the cartridge, the concept of the absence of staples in the present embodiment includes a state wherein a small amount of staples remain to a degree of not requiring to exchange the staple cartridge.

An explanation will now be provided of exchange of a staple cartridge.

Figure 14:
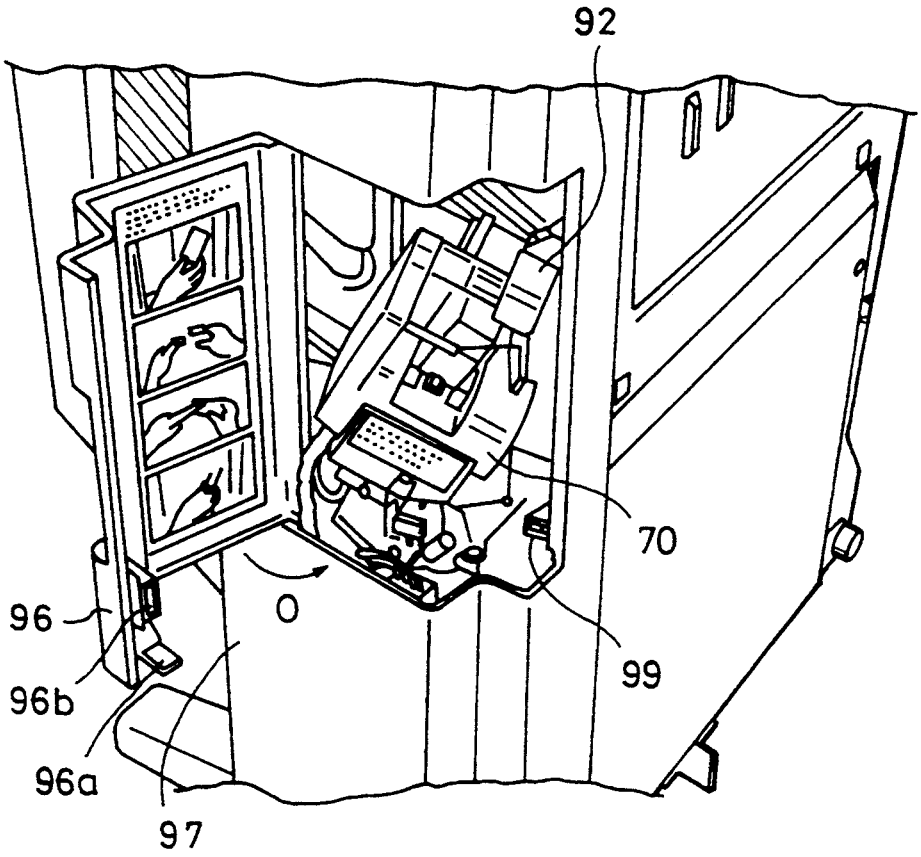
FIG. 14 is a perspective view of the stapling unit.

FIG. 14 is a schematic perspective view of the stapling unit of the sheet postprocessor of the present embodiment. In FIG. 14, an openable and closable door 96 is provided for the purpose of stapler maintenance and replacement of a staple cartridge. The lower portion of the door 96 comprises a projection for actuating a door switch. There is also shown a magnet catch 96*b* for holding the door. According to this configuration, if the door 96 is closed in the direction of arrow O, a joint switch 99 is switched on to permit the operation of the sorter 1.

In the present embodiment, if the door 96 is opened when the reflection-type staple sensor 93 of the stapler 67 detects the presence of staples, the stapler 67 is held at the retracted position 67X. At that time, the interlocking arm 91 is in a position represented by reference numeral 91X, that is, in a position wherein the lower portion of the interlocking arm 91 is rotated and pushed up by the staple-cartridge unit 69 of the stapler 67.

As shown in FIG. 13(*b*), the staple cartridge 69 includes a transparent main body of a case, a lower staple guiding path wall 69*a* extending from the main body, a cover 69*b* and a spring 69*c* for pushing the staples N by being pressed by the cover 69*b*. To remove staple cartridge 69 from the stapler 67, as indicated by symbol Z in FIG. 13(*a*), the rear end of the cartridge 69 is first raised, and the staple cartridge 69 is drawn out in the rear direction after it has ridden over a rear-end stopper portion 67*d* of the stapler 67. Hence, when the interlocking arm 91 is in the position represented by reference numeral 91X, that is, when the stapling unit is in the position represented by 67X (when the reflection-type staple sensor 93 detects the presence of staples), the staple cartridge 69 is interlocked so as not to be removed from the stapler 67.

Software is provided so that, if the door 96 is opened when the reflection-type staple sensor 93 detects the absence of staples (when the joint switch 99 is switched off), the staple unit automatically stops at the position represented by reference numeral 67Y (see FIG. 2). Hence, the staple unit moves and stops at the sheet stapling position 67Y (see FIG. 2).

When the stapling unit is at the above-described position, the interlocking arm 91 is retracted from the upper portion of the staple cartridge 69, as shown by solid lines in FIG. 13(*a*), and the staple cartridge 69 can be removed from the stapling unit by moving the rear end of the staple cartridge 69 as indicated by arrow Z shown in FIG. 13(*a*), When the door 96 is closed (when the joint switch 99 is switched off), the stapling unit returns to its standby position at the retracted position 67X (see FIG. 2).

In the present embodiment, when the door 96 is opened, if the staples are present, the stapling unit does not move and remains at the retracted position 67X. Alternatively, when the staples are present, the stapling unit may be moved to the sheet stapling position 67Y so that the interlocking arm 91 assumes the position represented by reference numeral 91X. When the staples are not present, the interlocking arm 91 may lock the staple cartridge 69 while the stapling unit continues to stop. The same effect may of course be provided by using an interlocking arm capable of being switched on and off by the drive of a solenoid, a motor or the like. For example, an electromagnet (a plunger) may be switched on in accordance with the movement of the stapler toward the stapling position to rotate the interlocking arm 91 in a clockwise direction, disengaging it from the staple cartridge 69.

As for the exchange of the staple cartridge, as described above, the absence of staples is detected when the rear end of the staple belt within the stapler passes the reflection-type staple sensor 93 in FIG. 13(*a*), and the system is temporarily stopped. At that time, bundles of remaining copies are automatically stapled after the supply of new staples.

Although, in the above-described embodiment, an explanation has been provided of a mechanical engaging and disengaging operation, an electrical engaging and disengaging operation may of course be performed. For example, a configuration wherein locking is performed using a magnetic force by an electromagnet may be adopted. In this case, the electromagnet may be switched on and off in accordance with whether the stapler is at the stapling position or at the retracted position.

Next, an explanation will be provided of alignment of the sheets P.

Figure 16:
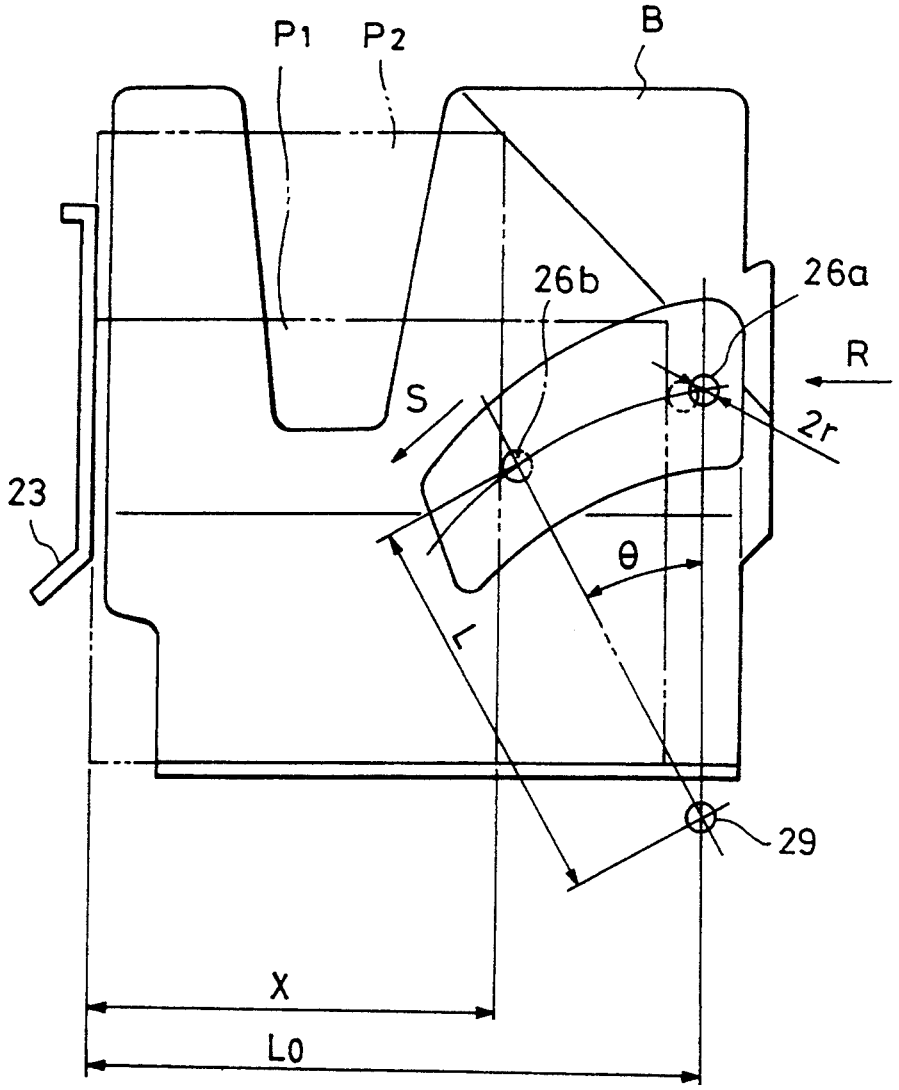
FIG. 16 is a plan view of a sheet-aligning unit including an aligning reference wall and an aligning member.

FIG. 16 is a transparent view of the bin unit 2 as seen from above. The aligning reference wall 23 is provided as a reference for pushing the sheets P thereagainst. The aligning bar 26 can perform a circular-arc movement around the center bar 29.

Figure 15:
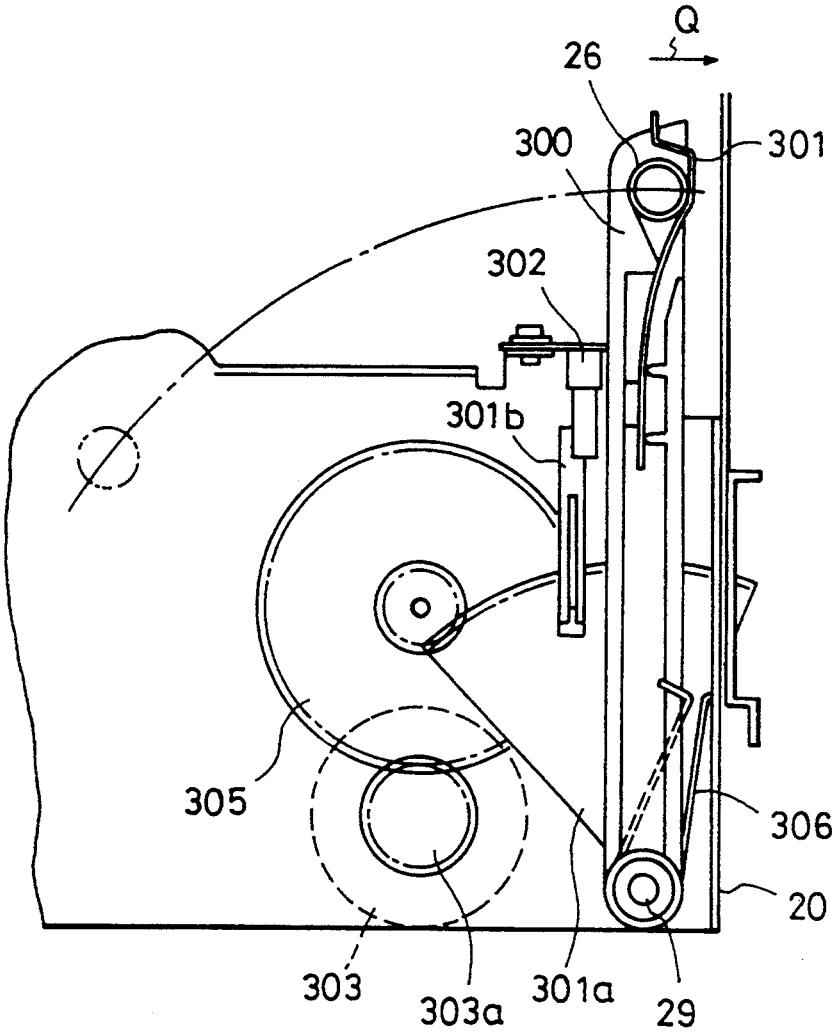
FIG. 15 is a plan view of a driving system for a bin unit.

FIG. 15 illustrates a driving system disposed at a lowermost portion of the aligning bar 26. In FIG. 15, a lower aligning arm 300 holds the aligning bar 26 in cooperation with the upper aligning arm 27 (as shown in FIG. 3). A leaf spring 301 can be deformed in a direction of moving the aligning bar 26 to the right relative to the aligning arms 27 and 300 in FIG. 15.

A fan-like gear 301*a* for driving the lower aligning arm 300 and a flag 301*b* for detecting the home position of the lower aligning arm 300 are provided by being formed as one body at part of the lower aligning arm 300. There are also shown a home-position sensor 302, a stepping motor 303 serving as a driving source, and an idle gear 305. A torsional coil spring 306 is hooked between the bin-supporting plate 20 and the lower aligning arm 300, and regulates the backlash of the fan-like gear 301*a* and the idle gear 305 always in one direction so as to prevent vibration due to the backlash at the transmission of normal and reverse drives of the stepping motor 303, or at switching between normal and reverse drives, thereby reducing operational noise. Furthermore, it has been confirmed by experiments that a vibrational sound (for example, a clattering sound peculiar to the stepping motor, or the like) is reduced by using a relatively soft resin for the idle gear 305 meshing with a stepping-motor gear 303*a*.

Next, an explanation will provided of positions of the aligning bar 26 and the aligning reference wall 23 when the sheet P is aligned.

First, the width of the sheet P is represented in FIG. 16 by x. For example, the width x is 297 mm for the A4 size, and 210 mm for the A4R size. In the present embodiment, a signal representing the size of the sheet is determined by a paper-size signal of the image forming apparatus. The value x also represents a distance between the aligning reference wall 23 and the aligning bar 26 when the sheet P is aligned.

Symbol "a" represents an amount of pushing of the sheet P by the aligning bar 26 (the paper width−the aligning width). Although the width of the sheet P is usually constant along its length, the width generally has some variations, and an apparent paper width also varies in accordance with a curled state of copying paper. Hence, the aligning bar 26 is pushed to a position corresponding to a width smaller than the paper width when the sheet P is aligned. In the present embodiment, the amount "a" is set so that $$a=\delta\cos\theta \quad (1),$$

where $\theta$ represents an angle of the aligning bar 26 relative to the home position 26*a* (an angle when the end portion of the aligning bar 26 reaches position 26*b* at the end portion of the sheet), and $\delta$ represents an amount of deflection of the leaf spring 301 in the direction Q, as shown in FIG. 15.

In the present embodiment, the pushing force against the sheet P by the aligning bar 26 is set to be the same for all sizes of the sheet P. This is because, when the number of mounted sheets is small, if the pushing force of the aligning bar 26 for the aligning arms 27 and 300 becomes greater than a predetermined value, a pressed mark is left on the portion of the sheet in contact with the aligning bar 26. When the pushing force of the aligning bar 26 is near the predetermined value, an effect of properly pushing the sheet P for aligning the sheet P is provided, thereby increasing alignability of the sheets P.

The amount $\delta$ of deflection of the leaf spring 301 is expressed by the following expression:

$$\delta=4Wl^3/bh^3E \quad (2),$$

where W, l, b, h and E represent a pushing force, the length of the leaf spring 301, the width of the leaf spring 301, a leaf pressure by the leaf spring 301, and modulus of longitudinal elasticity of leaf spring 301 (depending on the material of the leaf spring).

In the present embodiment, the value "a" when aligning the sheets P having the A4 size (the standard size) is about 1.5 mm from experiments. As shown by expression (1), the value "a" is reduced in the case of a size smaller than the A4 size (but the pushing force is constant; W).

A tilt angle q of the aligning bar 26 corresponding to the size of the sheet P is expressed by:

$$q=\pi/2-\cos^{-1}\{L_0-x-r\} \quad (3),$$

where $\pi$, $L_0$ and r represent the circular constant, the distance between the aligning reference wall 23 and the center bar 29, and the radius of the aligning bar 26.

Hence, the value $\theta_1$ for each size is calculated by expression (3). By inputting pulses for moving the lower aligning arm 300 by an amount $\theta_1$ to the stepping motor 303, the movement of the aligning bar 26 is achieved. Since the distance X between the end portion of the aligning bar 26 and the aligning reference wall 23 when aligning the sheet P is expressed by:

$$X=x-a \quad (4),$$

the value X is determined by $a=\delta\cos\theta$, where x represents the width of paper.

If the value 91 is further obtained, the number of pulses for the stepping motor 303 is finally determined from information relating to $\theta_1$. That is, the reason why the amount of pushing by the aligning bar 26 is reduced as the width of the sheet P is reduced is that, when the circular-arc-type aligning method as in the present embodiment is adopted, the direction of pushing the sheet P by the aligning bar 26 approximately equals the direction R shown in FIG. 16 for a wide size sheet (A4, A3 or the like). This direction is approximately perpendicular to the aligning reference wall 23, and no moment due to the pushing force is therefore applied to the mounted sheets P. Hence, alignability of the sheets P is not disturbed by the pushing force during the aligning operation.

On the other hand, in the case of a narrow size sheet (A4R, B5R or the like), the direction of pushing the sheet P by the aligning bar 26 is close to the direction S, and therefore has a certain angle relative to the aligning reference wall 23. Hence, a rotational force against mounted sheets P is applied. If the amount "a" of pushing exceeds a predetermined value, the force has a function of inhibiting alignment of the sheets P during the aligning operation.

In the present embodiment, an explanation has been provided of the circular-arc-type aligning operation. The above-described amount "a" of pushing having the predetermined value is also necessary for improving alignability when an aligning bar or an aligning plate is urged in a direction perpendicular to the aligning reference wall. The amount "a" of pushing when the above-described aligning bar performs a parallel movement need not be vary in accordance with a change of paper width.

Next, an explanation will be provided of the movement of the aligning bar 26 when the sheets P are stapled.

In the present embodiment, after the completion of the sheet aligning operation, and after all the copying sheets P have been discharged to the sorter 1, it is possible to automatically perform stapling. In stapling, the stapling unit moves in the sequence of the retracted position 67X to the sheet stapling position 67Y for a stapling operation and back to the retracted position 67X as shown in FIG. 2. As the stapling unit moves from the retracted position 67X to the sheet stapling position 67Y, the aligning bar 26 pushes the mounted sheets P against the aligning reference wall 23.

Figure 13A:
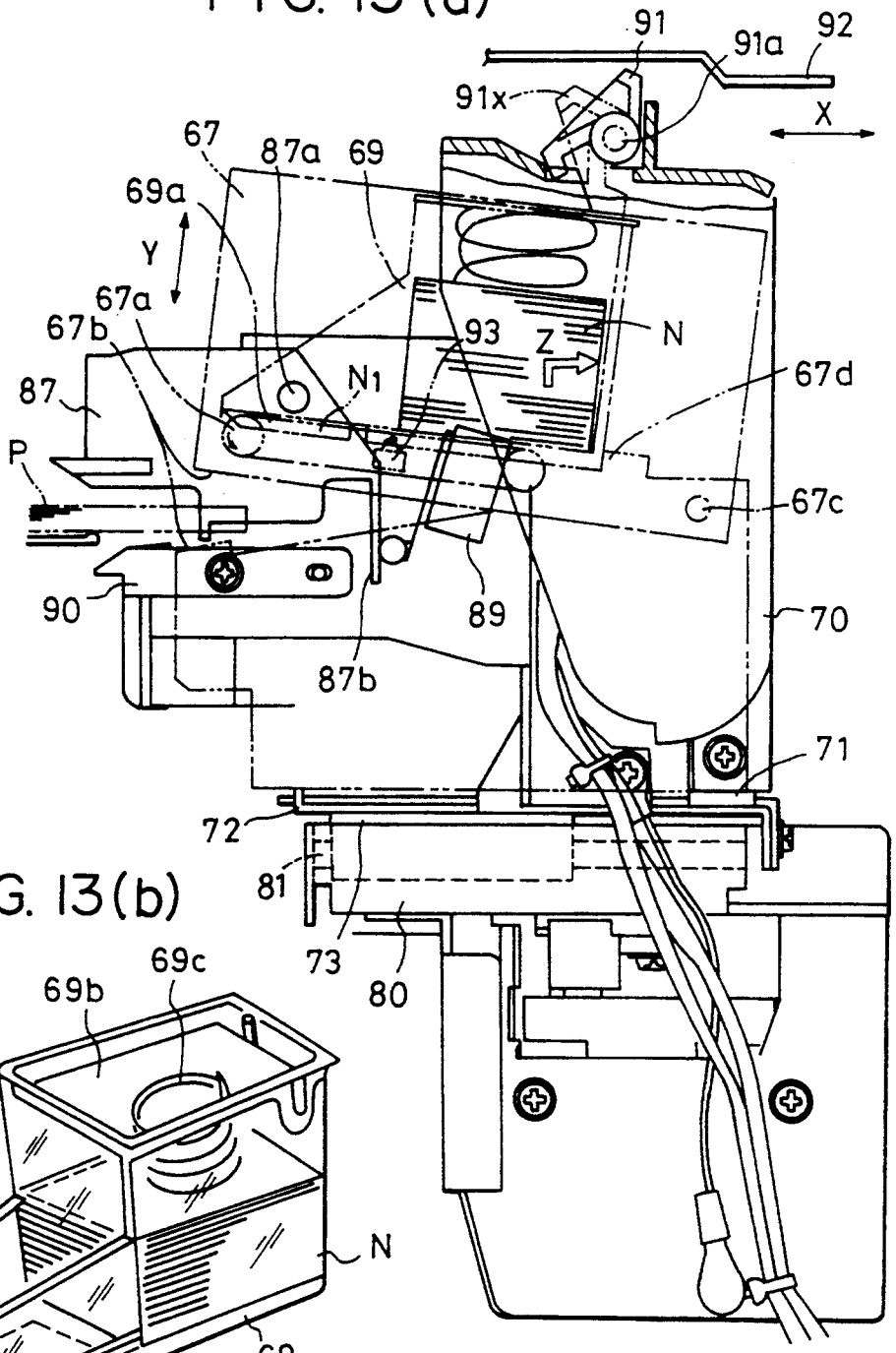
FIGS. 13(*a*) and 13(*b*) are side views of the stapling unit.
Figure 13B:
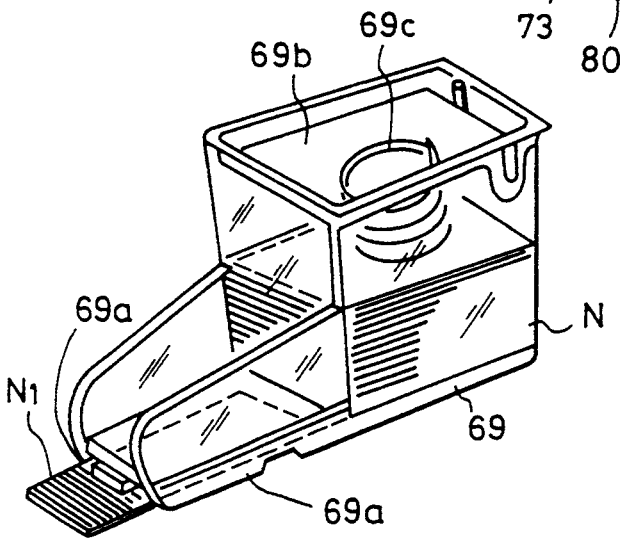

When the stapling unit enters between respective piles of the mounted sheets P, a pile of the sheets P moves between the upper unit and the lower unit of the stapler 67 while contacting (not contacting in some cases) the units via the upper tapered guide 87 and the lower tapered guide 90 as shown in FIG. 13(a). Hence, in order to improve alignability of the sheets P during the entering operation, the aligning bar 26 is in a state of pushing the mounted sheets P during the entering operation of the stapling unit, In the present embodiment, the mounted sheets P slightly move by the pushing force (direction) of the aligning bar 26 to minimize variations of the position of the staple during a stapling operation. Hence, there is provided a circuit which can control so that $$a \geqq a'(a' \approx 0) \quad (6),$$

where a' represents an amount of pushing during a stapling operation.

The above-described configuration is particularly needed in the circular-arc-type aligning method. In aligning the sheets P, if the number of the sheets P on the bin B is small, for example, about 20, the sheets P themselves whose stiffness in the width of the sheet P is greater than the spring force of the leaf spring 301 of the aligning bar 26 may perform extension/contraction movement by the pushing force of the aligning bar 26, or the entire sheets P may be twisted due to the moment produced by the force in the direction S shown in FIG. 16.

On the other hand, if the number of the sheets P exceeds 20, a small amount of misalignment may occur in some cases unless a certain amount of pushing force is applied on the sheets P. This is because, in the present embodiment, piles of the sheets P mounted in a plurality of bins (at least ten bins) are aligned by the same aligning bar 26. In consideration of parallelism of the aligning bar 26 from its upper and lower portions with respect to the aligning reference wall 23, the above-described variations (corresponding to the amount of tolerance in the width of the sheet P), curled condition of respective piles of the sheets P in respective bins, and the like, the amount "a" of pushing is also needed in aligning the sheets P.

In a stapling operation, as described above, in order to suppress variations in the stapled position, particularly in the case of a small number of narrow sheets (for example, A4R or B5R), the amount a' of pushing for minimizing disturbance of the sheets P when the stapling unit enters between piles of the sheets P is needed.

Alternatively, an approach, wherein the amount "a" of pushing is reduced when aligning a small number of sheets P, and the amount "a" is automatically increased when the number of the sheets P reaches a certain value (determined by a signal indicating the number of sheets from the main body or the sorter), is also meaningful in order to improve alignability. In the present embodiment, the above-described certain value corresponds to when the elastic force of the aligning arm and the leaf spring nearly equals the stiffness of the entire mounted sheets. The above-described configuration may of course be applied also for a parallel-moving-type aligning means.

An explanation will now be provided of a series of operations wherein the sheets P are carried from the image forming apparatus within the sorter 1 and discharged in the bins B, the bins B are shifted, and the sheets P are aligned and stapled.

First, the sheet P discharged from the image forming apparatus M connected to the sorter 1 (see FIG. 1) is carried from the carrying inlet 10, and is discharged in the bin B via the the pair of carrying rollers 11 and the deflector 17. In this discharging operation of the sheet P, in nonsorting, the sheet P is discharged from the pair of upper discharging rollers 13 in the bin B. In the sorting operation, the sheet P is discharged in the bin B from the pair of lower discharging rollers 16 via the second sheet conveying path 15.

Using a paper-discharge signal from the image forming apparatus, a passing time of the sheet P and an interval (between paper) between passage of consecutive sheets P are measured. The measured information is transmitted to a microcomputer provided within the bin unit 2.

If the time for detecting the sheet P exceeds a predetermined time from the previous sheet detection time due to occurrence of a failure in sheet conveyance, or the like, or if the next sheet P cannot be detected within a predetermined time, a stop/delay jam signal identical to that from a conventional jam sensor is issued for a microcomputer within the main body of the image forming apparatus, whereby the entire system is stopped.

The passing time of the sheet P and the interval between paper are measured. A microcomputer within the sorter 1 receiving that information recognizes a discharging time of the sheet P (a time during which the sheet P is discharged to the sorter 1) and the interval between paper. The rotation speed of the lead cam 43 is measured and position control of the lead cam 43 is performed using the above-described data. The position control of the lead cam 43 is performed by synchronizing the discharging timing of the sheet P within the bin B with the starting timing of the horizontal portion H (see FIG. 11) of the lead cam 43.

As described above, it is possible to recognize the speed of the lead cam 43 using the clock disk 56 (see FIG. 6) provided on the output shaft 45*a* of the shift motor 45 for driving the lead cam 43 and the interrupter 59, and to recognize one end and the other end of the approximately parallel portion H of the lead cam 43 using the flags 61 and 62 (see FIGS. 7 and 8) provided at the lower portion of the lead cam shaft 42.

For example, the number of revolutions of the lead cam 43 may be set so that, in a sorting operation with the bin unit 2 rising, discharging of the sheet P is started when the trunnion 33 of the bin B in which the sheet P is to be received reaches the home position 33*x* shown in FIG. 11, and discharging of the sheet P is completed while the trunnion 33 moves from the home position 33*x* to the position 33*y*.

The bin unit 2 is further shifted between the positions 33*y* and 33*z*. Since the interval between paper has been recognized using the above-described information, the trunnion 33 may perform rotation from the positions 33*y* to 33*z* within the interval between paper. At that time, the next bin B has already arrived at the position 33*x*, and the next sheet P is received. This operation is repeated for respective bins B.

In sorting with the bin unit 2 descending, discharging of the sheet P is started when the trunnion 33 of the bin B in which the sheet P is to be discharged reaches the position 33*y*, and discharging of the sheet P is completed while the trunnion 33 moves from the position 33*x* to the position 33*y*. The trunnion 33 rotates from the positions 33*x* to 33*y* within the interval between the discharged sheets P. At that time, the next bin B has already arrived at the position 33*y*. This operation is repeated for respective bins B.

During discharging operation of the sheets P, variations in the process speed of the main body of the image forming apparatus, in the interval between paper, and the like are detected and transferred from the main body of the image forming apparatus to the microcomputer of the bin unit 2 whenever any such variation occurs. Hence, speed control of the trunnion 33 is always subjected to feedback control according to new information.

According to the above-described configuration of the sorter 1, it is possible to deal with a difference in the discharging time due to a change in the size of the sheet P. Furthermore, even if the sorter 1 is connected to different image forming apparatuses having different process speeds and different intervals between paper, each image forming apparatus can perform optimal lead cam control. Hence, the sorter (sheet postprocessor) 1 can stably deal with a wide range of apparatuses.

Next, an explanation will be provided of sheet discharging and sheet alignment.

The sheet P discharged from the image forming apparatus and carried from the carrying inlet 10 is discharged from the pair of lower discharging rollers 16 in sorting.

During a sheet discharging operation, the bin B into which the sheet P is being discharged stops opposite to the pair of lower discharging rollers 16 (at that time, the lead cams 42*a* and 42*b* rotate, and the trunnion 3 passes the parallel portion of the lead cam). In normal sorting (wherein the bin unit 2 receives the sheets while moving from below to above), after the sheet discharging operation, the lower bin B which has received the sheet P rises at a predetermined time period $t_1$ after a sheet discharging signal has been detected by the paper sensor 19 and the rear end (in the direction of sheet conveying direction) of the sheet P has passed a nip portion of the pair of lower discharging roller 16, and the next bin B stops at a position facing the pair of lower discharging rollers 16.

The bin $B_b$ which has received the sheet P (see FIG. 9(*a*)) rises along the inclined portions K of the lead cams 42*a* and 42*b*. At that time, the space between the bin $B_b$ and the upper bin $B_a$ gradually narrows. Accordingly, before the bin $B_b$ has shifted and reached the position of the bin $B_a$, and the bin interval becomes narrow as indicated by symbol C, the aligning bar 26 pushes the sheet P discharged in the bin $B_b$ so as to bring sheet P in contact with the aligning reference wall 23, and sheet aligning is thus terminated.

If the number of mounted sheets P is small, sheet aligning is performed after the shift of the bin $B_b$ has been completed to minimize the space between the bin $B_b$ and the upper bin $B_a$, since the space between the bins is greater than the thickness of the pile of the sheets P and therefore alignment is possible. However, when a larger amount of sheets P are mounted and particularly when curling of the sheets P is great, it becomes difficult to completely push and align the discharged sheet P, since the mounted height of the pile of the sheets P becomes in some cases greater than the space C.

That is, if the condition shown in FIG. 9(*a*) is provided when the discharged sheet P is not pushed by the aligning bar 26, the entire stack of sheets P are pressed from above and below by the bins $B_a$ and $B_b$. At that time, aside from already aligned sheets P, an end portion of the sheet P immediately after being discharged (the sheet P which is not yet pushed against the aligning reference wall 23) may be deflected, or the sheet P may have a pressed mark, while the sheet P is not aligned due to the above-described load of the bins, causing insufficient alignment.

Accordingly, in the present invention, the discharged sheet P is aligned by the aligning bar 26 as the bin B shifts from the position $B_b$ to the position $B_a$ (that is, while the bin space C is wide). More preferably, aligning must be completed before the bin B completes to shift up after the discharged sheet P returns and contacts a front end stopper B' of the bin tray. Thus, the interval between sheets can be shortened, contributing to high-speed processing. In the case of rise, however, since the bin tray shifts in a direction separated from the discharging inlet to approach the discharged sheet, alignability is not significantly impaired even if the sheet P is pushed by the aligning bar 26 before the sheet P contacts the front-end stopper B' of the bin tray.

In reverse sorting (wherein the bin descends after receiving the sheet P), as shown in FIG. 9(*a*), the sheet P is discharged in the bin B*b*, which moves to the position of the bin $B_c$. In this case, the discharged sheet P is aligned by the aligning bar 26 after the sheet P has been discharged and the bin $B_b$ has moved to the position of the bin $B_c$.

When the bins B move in the descending direction, the angles of the bins $B_b$ and $B_c$ differ from each other, as shown in FIG. 9(*a*). Hence, if aligning is performed while the bin $B_b$ moves from the positions $B_b$ to $B_c$, wherein already-aligned mounted sheets (the already-aligned sheets are also pushed by the aligning bar 26 when the discharged sheet is aligned) are pushed while the angle of the mounted sheets P changes (while the bins B descend), misalignment occurs. Accordingly, during the descending movement of the bins B, the aligning bar 26 aligns the discharged sheet P after the bin $B_b$ has shifted down from the position $B_b'$ to the position $B_c'$.

The above-described misalignment occurs because, if the sheet P is pushed while the sheets P in the bin B are descending, the sheet P floats from the bin B, and is deflected and disturbed. In the above-described aligning operation of the sheet P, since the space D between the bins $B_b$ and $B_c$ is widened in the case of the descending movement of the bins B, it is possible to stack a sufficient amount of sheets P even if curling of the sheets P is great, in contrast to the case of the rising movement of the bins B.

As another approach, after discharge of the sheet P into bin $B_b$, the bin $B_b$ may rise or descend after aligning the sheet P, and move to the positions $B_a$ and $B_c$ in normal and reverse sorting operations, respectively. Also in this approach, the sheet P can be mounted and aligned. In this case, unless the sheet P is aligned after the rear end of the discharged sheet P has contacted the stopper member B' of the bin B, alignability of the sheet P is reduced (mounted by being twisted) due to a moment applied to the sheet P when the aligning bar 26 pushes the sheet P. Accordingly, alignment must be performed after the sheet P contacts the stopper unit B'.

By moving the bin B after the discharged sheet P has been correctly aligned, it is also possible to align the sheets P within the bin B. In this case, although an image forming apparatus having a slow process speed and a long interval between paper can be dealt with, a high-speed machine (at least 60 cpm (copies per minute)) having a high process speed and a short interval between paper cannot be dealt with if the bin is shifted after waiting the above-described time. Hence, the above-described configuration of the present embodiment is needed.

The above-described timing of alignment is determined by counting a predetermined time period by a counter after detecting the sheet P by a sensor.

Next, an explanation will be provided of a stapling operation of the sheets P after alignment.

In the present embodiment, when all copying sheets are discharged and aligned within the bins B, stacks of the sheets B are stapled sequentially from the last bin B in which the sheets P have been aligned.

The above-described processing will now be briefly explained. After the last sheet has been aligned, the aligning bar 26 pushes again the mounted bundle of sheets (the entirety of sheets within the bin) against the aligning reference wall 23. At that time, because of the above-described reason, in the present embodiment, the amount of pushing by the aligning bar 26 is smaller than during alignment (the amount "a" of pushing during alignment is arranged so that "a"=0). According to the above-described configuration, alignability is improved from a small number of sheets P to a large number of sheets P.

As described above, the entire stack of sheets P are held by the aligning bar 26. A curling suppressor (not shown) for the sheets P is disposed near the sheet inlet having the upper tapered guide 87 and the lower tapered guide 90 at the opening of the stapling unit. The curling suppressor regulates mainly a sheet P having a large degree of upper curling to maintain it lower than a predetermined amount (a height from the surface of the bin B to a taper-starting portion of the upper tapered guide 87).

In this condition, the stapling unit having the above-described configuration moves from 67X to 67Y in FIG. 2. At that time, upper curling of the sheets P on the bin B is regulated by the curling suppressor. Lower curling hanging from the end portion of the bin B is raised by the tapered portion of the upper tapered guide 90, and the apex portion of the lower tapered guide 90 functions as a .jump platform so that the sheets P are not caught in the opening of the stapler 67. According to this configuration, it is possible to stably advance the sheets P mounted on the bin B into the opening of the stapler 67 even if the sheets P have upper or lower curling.

When the stapling unit reaches the position 67Y, the sheets P are detected by the transmission-type sensor 86 (FIG. 12), and the sheets P are stapled only when the sheets P are mounted on the bin B. After the completion of stapling of the sheets P, the stapling unit returns again to the retracted position 67X where the stapling unit does not interfere with the sheets P on the bin B even if the bin B shifts.

When the stapling unit returns to the retracted position 67X, a stapling-unit-position-detecting microswitch 83 is switched off to permit the shift motor 45 to rotate. The bin unit 2 is thereby shifted up or down, and a stapling operation for the next bin B is started in the same manner as described above.

If the bin B shifts when the stapling unit is at the position 67Y, the front end of the stapling unit may interfere with the sheets P and the bin B and damage the sheets. Accordingly, a current supply circuit for the bin unit is mechanically connected only when the stapling-unit-position-detecting microswitch 83 is switched off so that a bin-shifting operation is never performed when the stapling unit is at the position 67Y even if software erroneously instructs it to do so.

When the stapling operation is started under circumstances, for example, where the stapling unit malfunctions, or the number of sheets P in bin B exceeds a staplable amount, and the stapler 67 stops during the operation due to overload, if the stapling unit returns to the position 67X and the bin B shifts in that state, the sheets P may be torn. In such a case, a one-revolution (one-process) sensor (not shown) mounted in a timer circuit within the stapler 67 detects that the stapler 67 does not return to the home position within a predetermined time period after starting the operation. The stapler 67 is then returned to the home position by being rotated in a direction reverse to one revolution (in the direction to operate the spring) of the stapler 67. Subsequently, the stapling unit is returned to the position 67X.

In this case, since the stapling unit cannot perform one revolution in a predetermined direction, a stapler abnormal signal is issued from a control circuit (not shown), and abnormality is displayed on a display unit or the like un the main body of the image forming apparatus.

In the present embodiment, if the drive of the stapler has been reversed, it is assumed that the stapling unit is abnormal, and an abnormal signal is issued. However, for example, even if the stapling unit is reversely rotated and returns to the home position, the stapling unit resumes in some cases a normal operation after another revolution in a predetermined direction. That is, when a staple is abnormally fed only once, if the stapler 67 is reversely rotated while locking only one process, the next stapling process returns in some cases to a normal state.

In such a case, since it is improper to determine to stop the system (failure in stapling) with issuing an abnormal signal according to only one reverse revolution of the stapler 67, the number of the reverse revolution may be increased to at least two, or the number of processes for determining abnormality may of course be increased to two or three. For example, if the stapler 67 is reversely rotated at the first bin B, the bin B may be shifted, and the stapling operation for the next bin B may be started in order to perform a second trial. At that time, if the stapler 67 normally performs a one-revolution stapling operation, the system will be continued. If the stapler 67 is reversely rotated also the second time, an abnormal signal of the stapling operation will be issued at that time.

Next, an explanation will be provided of a lined-up operation of the sorters.

Figure 27:
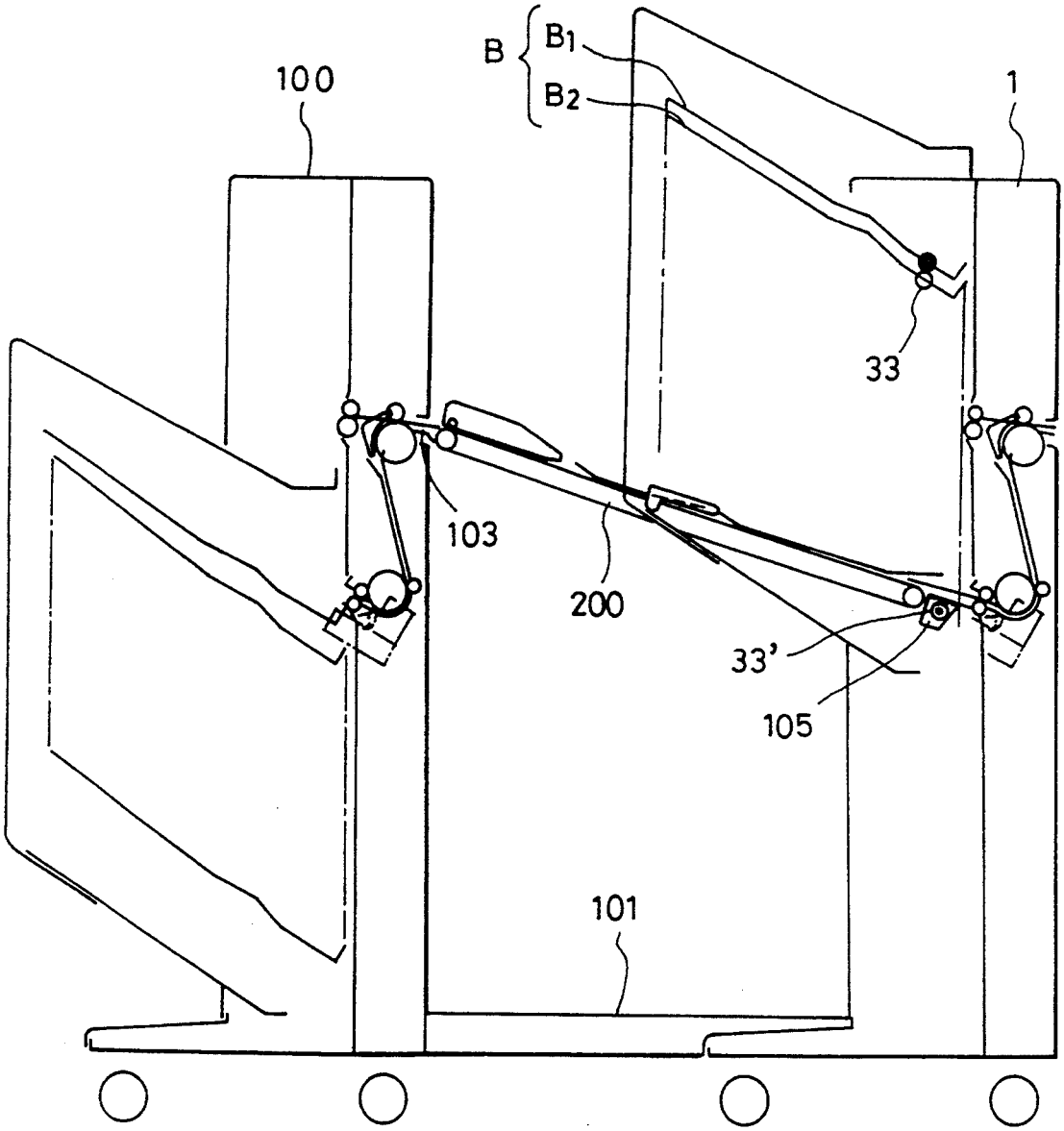
FIG. 27 is a sectional side view of lined-up sorters.

FIG. 27 is a schematic cross-sectional view of two lined up sorters. In the present embodiment, a sorter 1 (in the first line) and a sorter 100 (in the second line) are entirely the same. By connecting the two identical sorters in series, twice the amount of copying paper as when a single sorter is used can be received.

Figure 28:
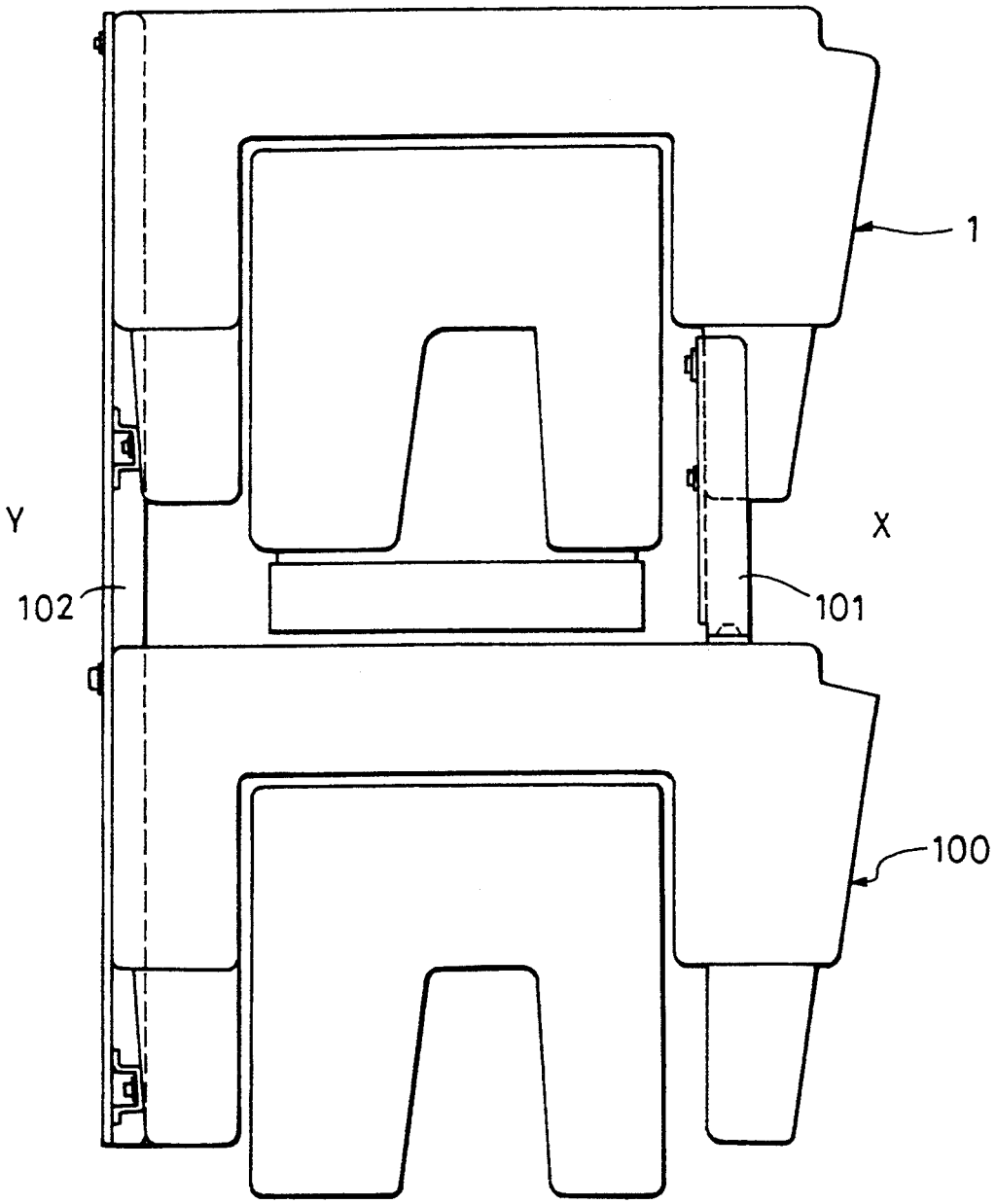
FIG. 28 is a plan view of the lined-up sorters.

FIG. 28 is a view of the lined-up sorters as seen from above. In the present embodiment, the sorters 1 and 100 are connected by screwing rail members 101 and 102 on the front side X and the rear side Y of the sorters 1 and 100.

Communication and electric power supply between the first and second sorters are performed via cords drawn from power-supply-cord mounts (not shown) each provided at a rear portion of each of the sorters 1 and 100. By inserting the cord of the sorter 100 in a connector of the power-supply-cord mount of the sorter 1, and inserting the cord of the sorter 1 in a connector of a power-supply-cord mount (not shown) provided at a rear portion of the image forming apparatus, information and electric power are supplied and transmitted in the sequence of from the image forming apparatus to the sorter 1 to the sorter 100.

The present embodiment has the advantage that any number of a plurality of sorters may be connected as long as power supplies permit. Although, in the present embodiment, two sorters are lined up, even three or four sorters may be lined up so that a larger amount of copying paper can be received in the sorters provided that space and a power supply for installing the sorters are available.

Next, an explanation will be provided of the configuration of a paper path between the sorters 1 and 100. In the present embodiment, connecting stays 105 are disposed at lowermost portions of the bins B. Trunnions 33' are rotatably supported at side portions of the connecting stays 105, and a connecting conveying path unit 200 is detachably mounted on the connecting stays 105 by being screwed or by any other holding means.

According to the above-described configuration, when the trunnions 33' at the side portions of the connecting stays 105 rise or descend by the lead cams **42*a* and 42*b*, the connecting conveying path unit 200 can also rise or descend, and it can rise to a predetermined position and receive the sheet P at a position (the position where the bin B receives the sheet P; the parallel portions of the lead cams) facing the pair of lower discharging rollers 16 of the sorter 1**.

Next, the configuration of the conveying path unit 200 will be explained.

Figure 29:
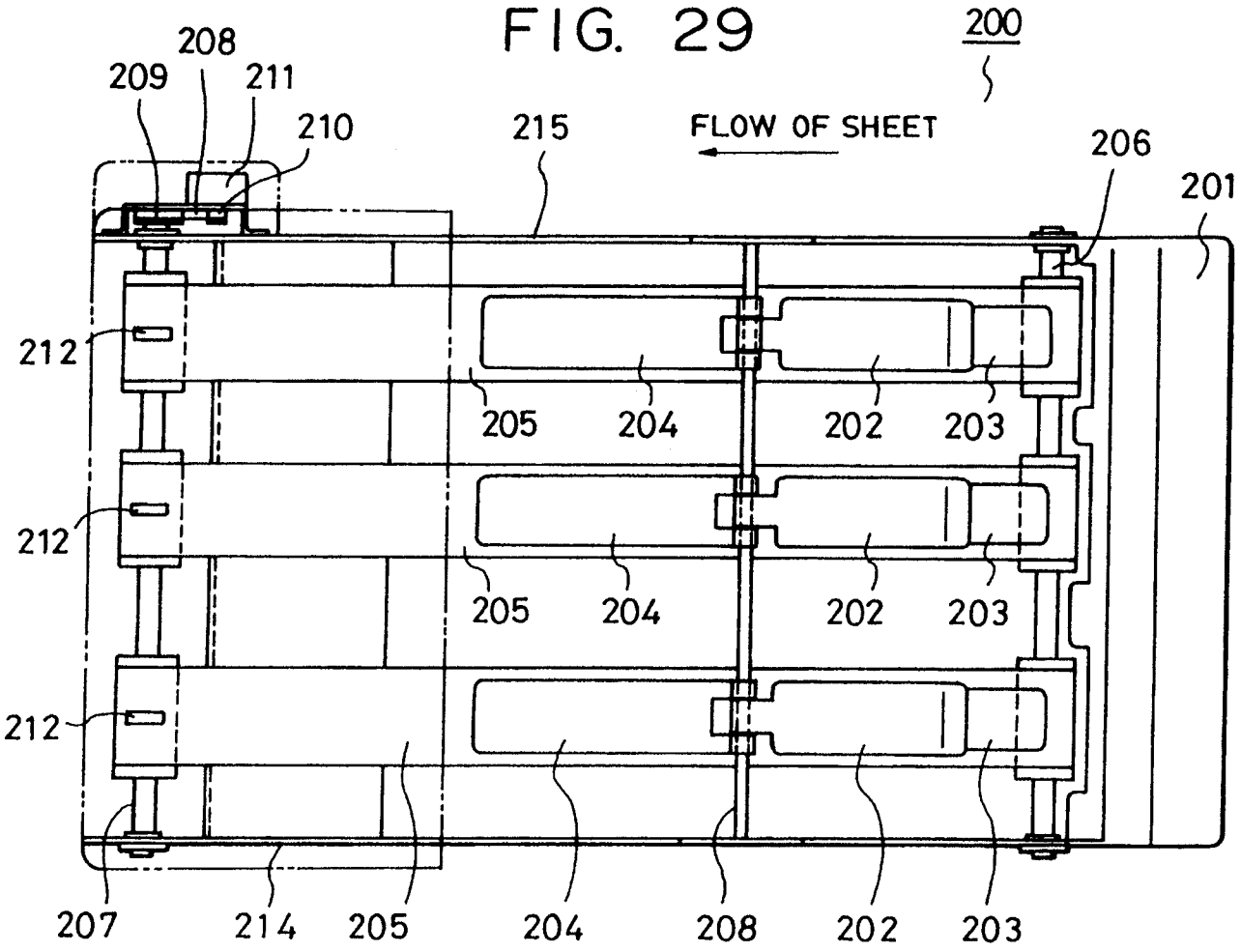
FIG. 29 is a plan view of a conveying path for the lined-up sorters.

In FIG. 29, there is shown an entrance guide 201 of the connecting conveying path unit 200, and also entrance weights 202 for conveying the sheet P. A leaf spring 203 is provided at a front-end portion of each of the entrance weights 202, and is usually in pressure contact with the upper bin B to guide insertion of the sheet P when the two sorters are lined up.

FIG. 29 is a plan view of the connecting conveying path unit 200. In FIG. 29, rubber belts 205 are stretched between roller shafts 206 and 207. A timing belt 208 is stretched between a pulley 209 of the shaft 207 and a pulley 210 of a motor 211. The roller shaft 207 and the rubber belts 205 are driven by the rotation of the motor 211 via the timing belt 208.

The entrance weight 202 and an intermediate weight 204 both swingable around a shaft 208 are provided on each of the rubber belts 205. The sheet P discharged by the pair of lower discharging rollers 16 is conveyed onto the rubber belts 205 by the entrance guide 201, and is conveyed toward a downstream side by the entrance weights 202 and the intermediate weights 204. Paper-discharging rollers 212 are disposed at an output portion of the conveying path unit 200, and have the function of guiding the sheet P to an inlet 103 of the sorter 100.

Figure 30:
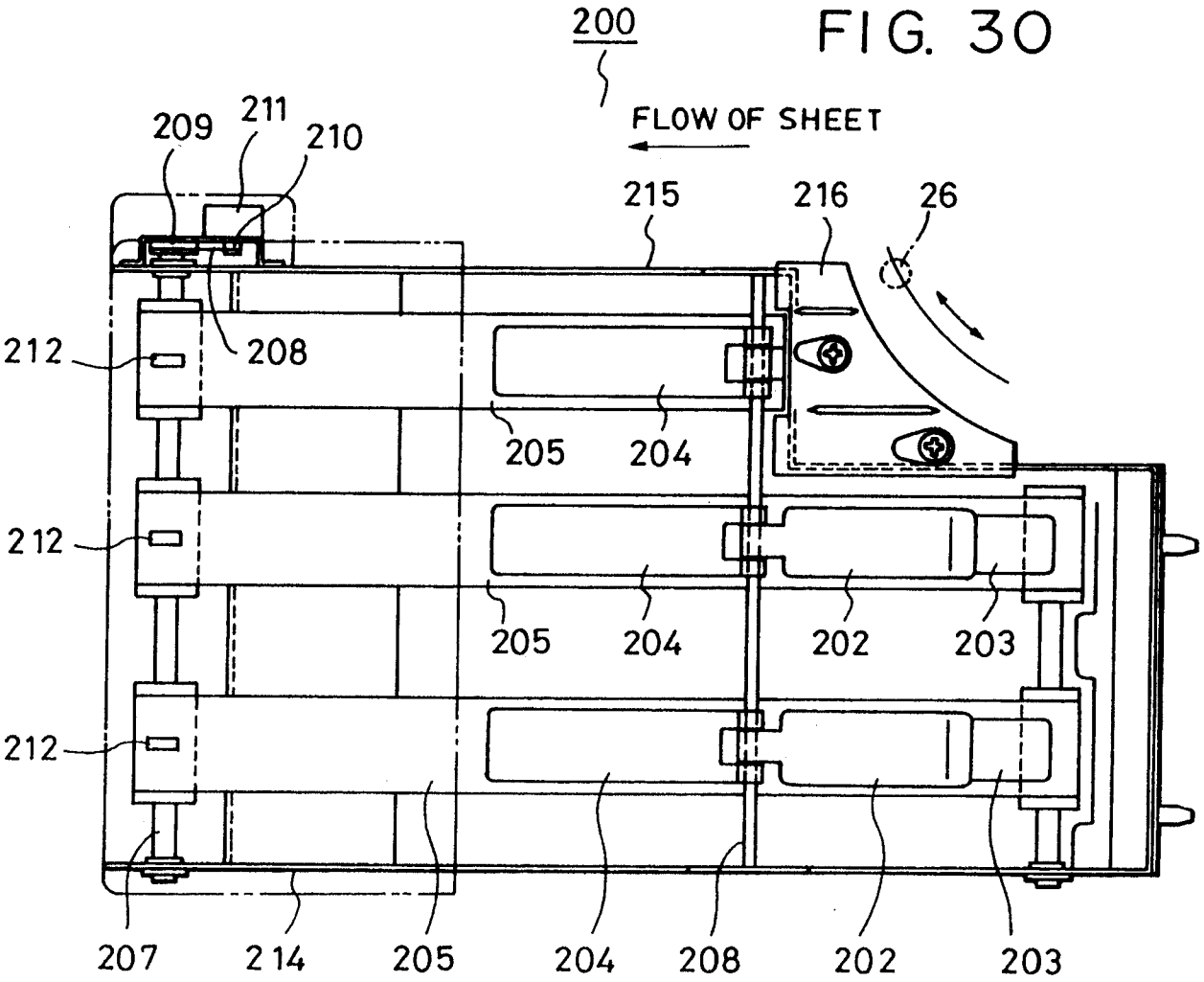
FIG. 30 is a plan view of the conveying path provided with an aligning drive.

In the case of using a sorter where the aligning bar 26 is threaded within the bin unit and sheets P can be aligned, a unit for driving the aligning bar 26 is provided at a lower portion of the connecting conveying path unit 200. A portion in the connecting conveying path unit 200 corresponding to an operational region of the aligning bar 26 is cut as in the bin B. In order to improve sheet conveyability of a cut portion, as shown in FIG. 30, a smooth sheet guide 216 is screwed (screws are buried below the conveying path so as not to interfere with the sheet P) or fixed by any other means in the cut portion.

Next, the flow of the sheet P to the connecting path will be explained.

In the present embodiment, when preparing a number of copies greater than the number of bins in a single sorter, for example, when the first sorter has n bins and $n+\alpha$ bundles of copies are to be made, the first sorter completes stapling of n bundles. The first sorter then performs a $(n+1)$ bin shift, and the connecting conveying path unit 200 is shifted to a position facing the pair of lower discharging rollers 16, as described above. Subsequently, sorting (or grouping) of remaining bundles of copies is performed, and a stapling operation is completed if necessary.

During the above-described operation, the bundles of copies subjected to postprocessing in the first sorter may be taken out. If the relationship between the above-described n and $\alpha$ is that $n<\alpha$, postprocessing (sorting or grouping/stapling) for the remaining bundles is automatically performed again in the first sorter after the completion of postprocessing in the second sorter. At that time, transmission-type through-bins sensor 400, 400' (see FIG. 4) determine whether any remaining bundles of sheets from the preceding processing in the first sorter remain. The postprocessing is automatically started only when no sheets P remain in the bins B. If any sheets P remain in the bins B, postprocessing is not started until the user removes all remaining sheets.

The first advantage of the present configuration is that an infinite number of necessary copies may be set in the image forming apparatus. Postprocessing is performed in units of n bins for receiving sheets per sorter, and is performed in the sequence of the first sorter, followed by the second sorter, and then followed by the first sorter. While the first sorter performs postprocessing, bundles of sheets received in the second sorter and subjected to postprocessing are removed. After removing the bundles of sheets, postprocessing in the second sorter is automatically resumed after the completion of postprocessing in the first sorter. Thus, the system may form an infinite loop. The present configuration may be applied for at least two sorters, or even for a single sorter. In the case of using a single sorter, after n bundles of copies corresponding to the number of bins have been prepared, all sheets P are removed. Subsequently, postprocessing is automatically started to prepare bundles of remaining copies.

When the above-described lined-up sorters are connected to an image forming apparatus having an original feeder provided with a reservation function for originals, it is necessary to deal with users of an original receiving shelf of the original feeder, a receiving shelf of a reservation device and the like.

For example, the following approach is possible: Preparation of bundles of copies from an original in the original receiving shelf is started in the first sorter. After the completion of the preparation of the bundles, postprocessing for bundles of copies from an original in the receiving shelf of the reservation device is automatically performed in the second sorter. A first user can take out the bundles of copies from the first sorter when the copying operation of his own original has been completed (even if postprocessing for copies of a second user is performed in the second sorter). When the first user has taken out his bundles of copies, the first sorter can deal with a third user who has placed his original in the receiving shelf of the reservation device. Thus, it is possible to expand the system.

The first and second sorter may have a stapling function as in the present embodiment, or may not have a stapling function. Alternatively, only the first sorter may have a stapling function, and the second sorter may not have a stapling function, or vice versa. When the first and second sorters have a stapling function, and for example, copying is performed in an autostapling mode, if staples are exhausted in the first sorter but are present in the second sorter, the absence of staples in the first sorter is detected, and the autostapling mode is automatically started in the second sorter.

Figure 17:
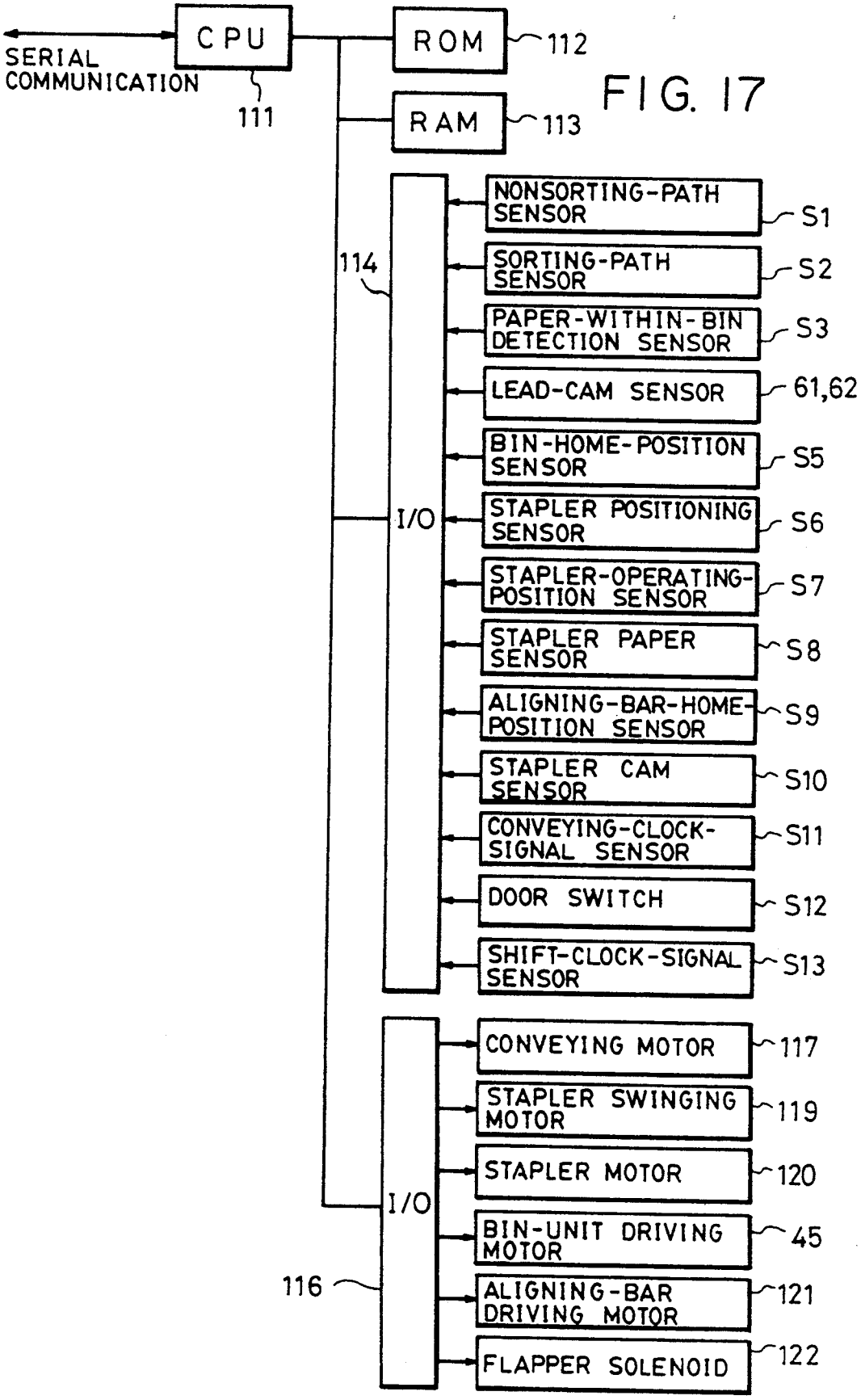
FIG. 17 is a block diagram illustrating a control device for the sheet sorter of the present invention.

As shown in FIG. 17, the sorter 1 shown in FIG. 1 includes a control device comprising a central processing unit (CPU) 111, a read-only memory (ROM) 112, a random access memory (RAM) 113, an input port 114, and an output port 116. The ROM 112 stores control programs. The RAM 113 stores input data and data for operations, A number of sensors, such as a nonsorting-path sensor S1 and the like, and a door switch S12 are connected to the input port 114. Loads, such as a conveying motor 117 for driving the pair of carrying rollers 11 and the pair of lower discharging rollers 16 are connected to the output port 116. The CPU 111 controls the respective units connected thereto via a bus in accordance with control programs stored in the ROM 112. The CPU 111 includes a serial interface to perform, for example, serial communication with a CPU of the main body of the copier, and controls the respective units according to signals from the main body of the copier.

The operation of the present embodiment will now be explained according to the flowcharts shown in FIGS. 18(*a*) through 24.

Figure 18:
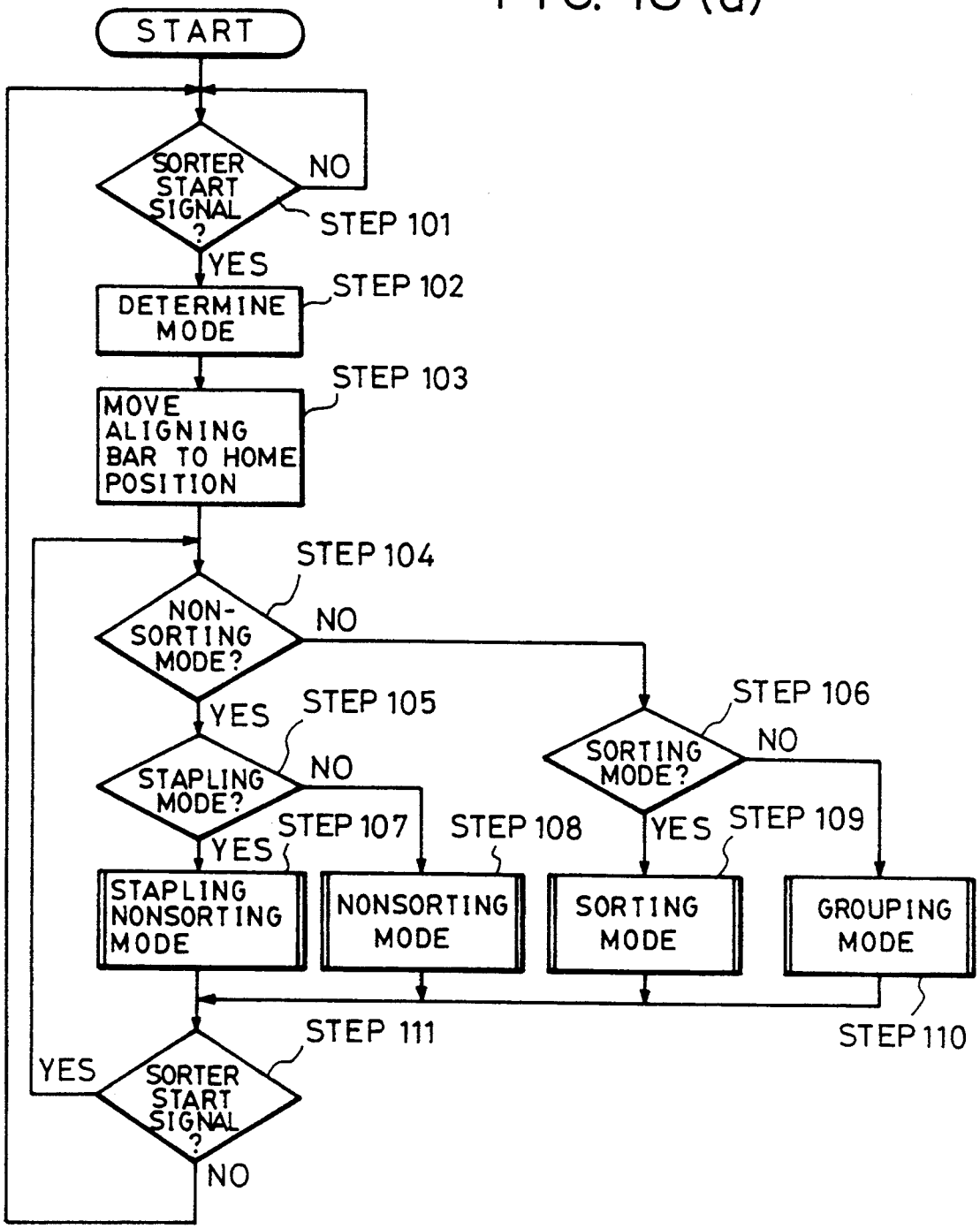
FIGS. 18(*a*)–26 are flowcharts of the embodiment.
Figure 18B:
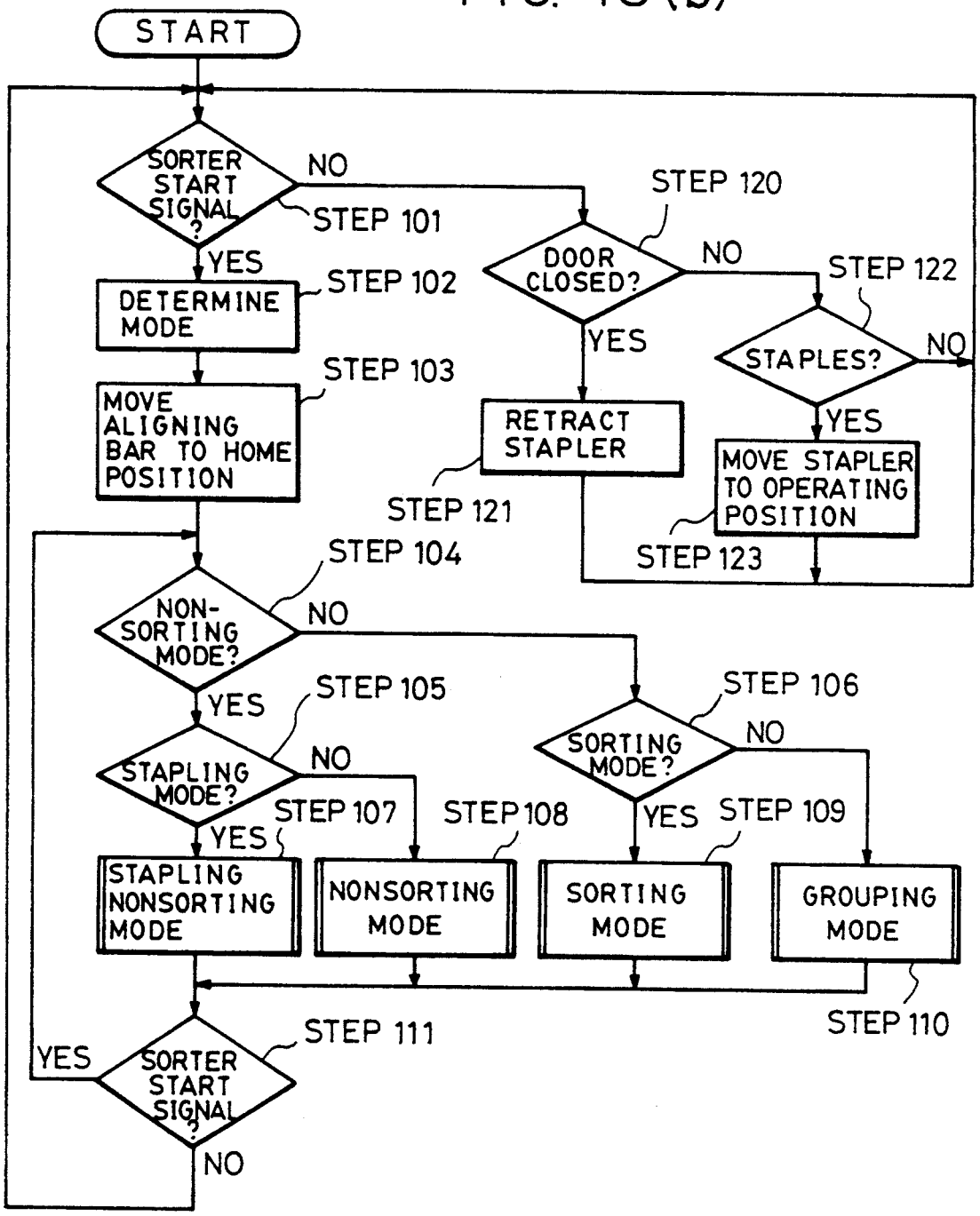

First, as shown in FIG. 18(*a*), if, for example, a copy-start key on the main body of the copier is depressed to start a copying operation, a sorter start signal is transmitted from the main body of the copier in the form of a serial signal. The sorter 1 has been waiting for the signal (Step 101). When the sorter start signal has been transmitted, the program proceeds to Step 102. At Step 102, the mode of an operation for a time period of one job until the sorter start signal disappears is determined, and mode data is stored in the RAM 113. In order to detect the position of the aligning bar 26, the aligning bar 26 is first returned to the home position (Step 103). Subsequently, respective units are operated according to the mode determined at Step 102. That is, at Step 104, it is determined whether or not the current mode is a nonsorting mode. In the case of the nonsorting mode, it is determined whether or not stapling is to be performed (Step 105). The program proceeds to a stapling nonsorting mode when stapling is to be performed (Step 107), and the program proceeds to the nonsorting mode when stapling is not to be performed (Step 108). If it has been determined that the current mode is not the nonsorting mode at Step 104, the program proceeds to Step 106, where it is determined whether or not the current mode is a sorting mode. In the case of the sorting mode, the process proceeds to Step 109 for the sorting mode. When the current mode is not the sorting mode, the current mode is determined to be a grouping mode, and the program proceeds to Step 110. After the completion of the operation at any of the above-described modes, the program proceeds to Step 111, where it is determined whether or not a sorter start signal is present, that is, whether one job has been completed. When a sorter start signal is present, it is determined that one job is not completed, and the program returns to Step 104. When a sorter start signal is not present, it is determined that one job has been completed, and the program proceeds to the initial Step 101.

In an alternative approach, as shown in FIG. 18(*b*), if it has been determined that a sorter start signal is absent at Step 101, the program proceeds to Step 120, where it is determined whether or not the door 97 of the stapling unit is opened. If the door 97 is closed, the program proceeds to Step 121, where the stapler 67 is retracted, and the program returns to Step 101. On the other hand, if it has been determined that the door 97 of the stapling unit is not closed at Step 120, the program proceeds to Step 122, where it is determined whether or not the staple supply is exhausted. If staples are absent, the program returns to Step 101. If staples are present, the stapler 67 is moved to the operating position (Step 123), and the interlocking mechanism of the staple cartridge 69 is released.

Figure 19:
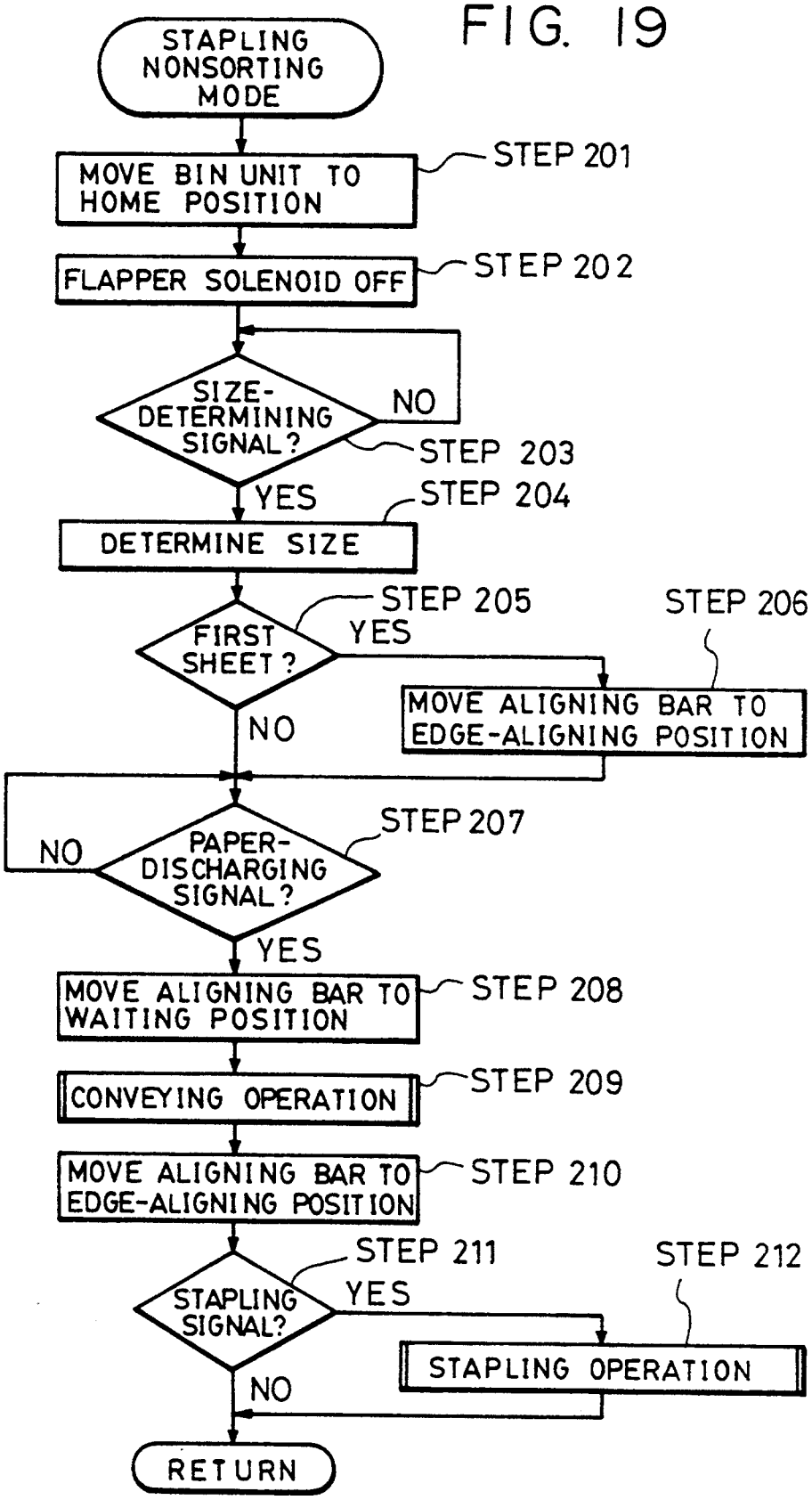

FIG. 19 shows the operation in the stapling nonsorting mode.

The position of the bin unit 2 in the stapling nonsorting mode is the home position. At Step 201, the bin unit 2 is moved to the home position. At that time, the stapler (sheet stapling mechanism) 67 cannot staple sheets mounted on the bin cover 22, but staples the sheets P received in the bin B. When the stapling mode is selected, even in a nonsorting state, it is necessary to provide the sheets P in the bin B. Hence, the flapper solenoid 122 is turned off, and the discharging port for sorting (the pair of lower discharging rollers) 16 is selected (Step 202). Subsequently, it is awaited until a size-determining signal arrives (Step 203). If a size-determining signal arrives, the program proceeds to Step 204. At Step 204, data of the paper size transmitted from the main body of the copier is stored in the RAM 113. If the sheet discharged from the main body of the copier is the first sheet (Step 205), the aligning bar 26 which must be at the home position is moved to an edge-aligning position 26*a* (Step 206). When it has been determined that the discharged sheet is not the first sheet at Step 205, or after the aligning bar 26 has been moved to the edge-aligning position 26*a* at Step 206, the program proceeds to Step 207. At Step 207, the program waits until a paper-discharging signal for the main body of the copier is received. If a paper-discharging signal arrives, the aligning bar 26 is moved from the edge-aligning position 26*a* to the waiting position 43*b* (Step 208), the sheet is conveyed within the bin B (Step 209), the aligning bar 26 is moved to the edge-aligning position 26*a* to align the sheet (Step 210), and the program proceeds to Step 211. At Step 211, it is determined whether or not a stapling signal is present. If the result of the determination is affirmative, a stapling operation is performed (Step 211). If the result of the determination is negative, the program returns to the main routine.

Figure 20:
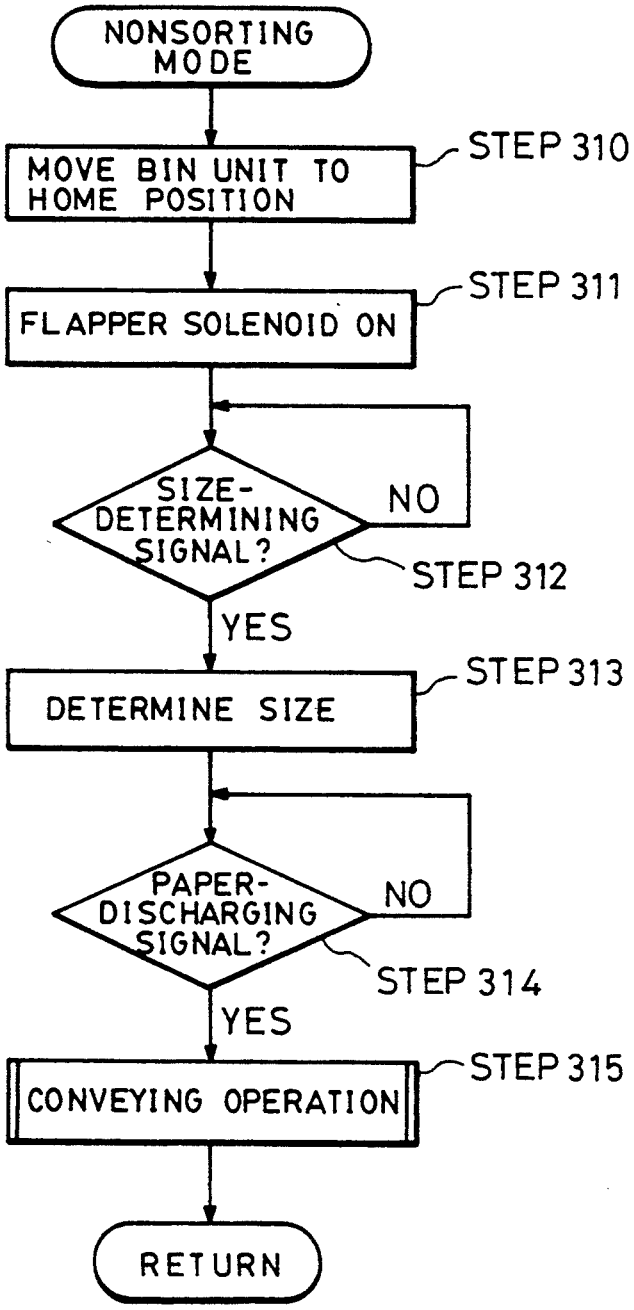

Next, the operation in the nonsorting mode will be explained with reference to FIG. 20.

In the nonsorting mode, since the sheet is discharged onto the bin cover 22, the bin unit 2 is moved to the lowermost position, which is the home position (Step 310), and the flapper solenoid 122 is turned on in order to discharge the sheet from the paper discharge rollers 13 for nonsorting (Step 311). Subsequently, the program waits until a size-determining signal arrives (Step 312). If a size-determining signal arrives, the size is determined (Step 313), and the program proceeds to Step 314. At Step 314, a paper-discharging signal from the main body of the copier is awaited. If a paper-discharging signal arrives, the program proceeds to Step 315, where the sheet is discharged onto the bin cover 22, and the program returns to the main routine.

Figure 21:
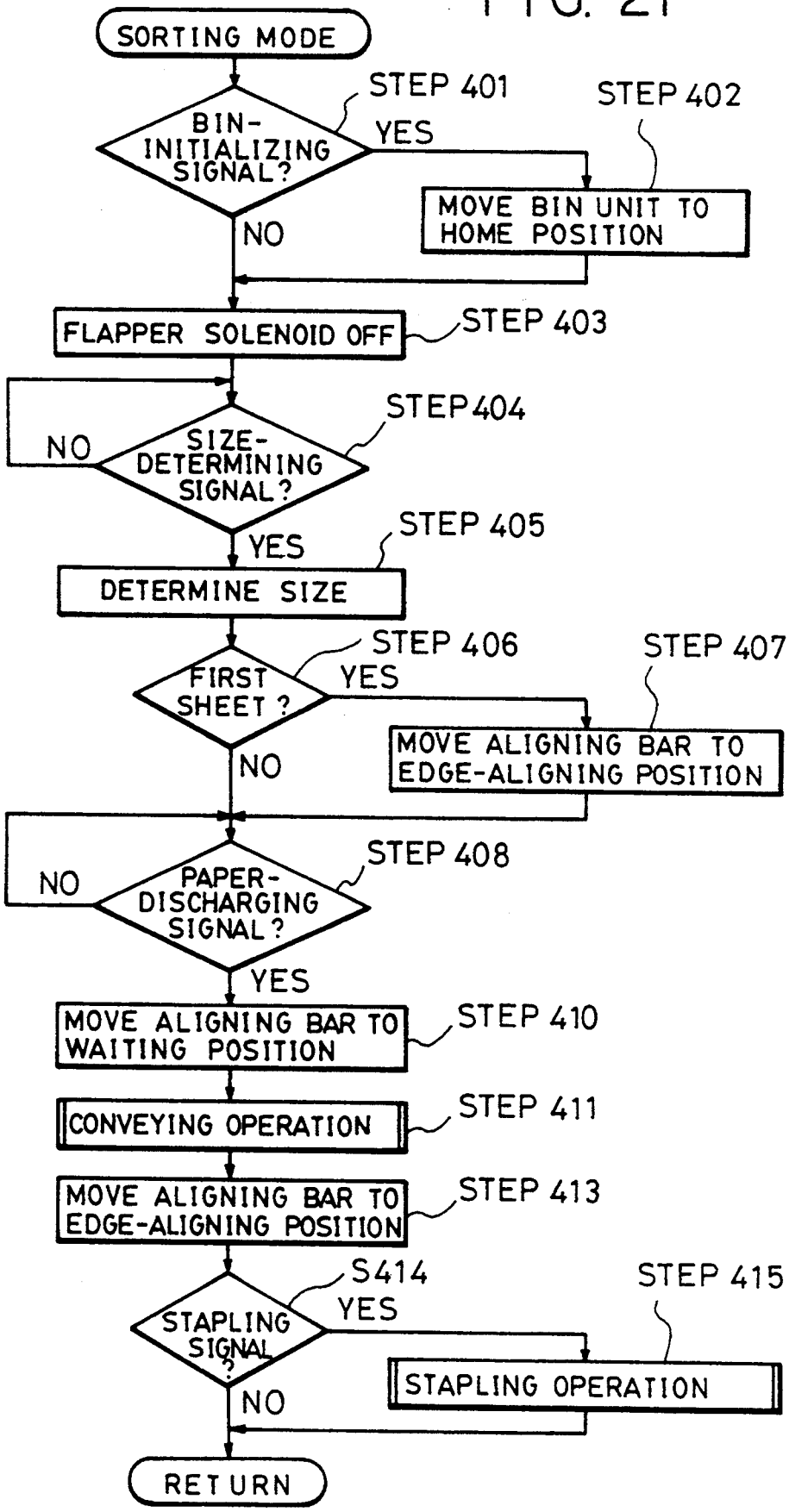

Next, the operation in the sorting mode will be explained with reference to FIG. 21.

First, it is determined whether or not a bin-initializing signal from the main body of the copier signals that bin unit 2 must be returned to the home position (Step 401). The bin unit 2 is moved to the home position only when a bin-initializing signal is present (Step 402). Subsequently, the flapper solenoid 122 is turned off in order to select the discharging outlet 16 for sorting (Step 403), and the program proceeds to Step 404. At Step 404, the program waits until a size-determining signal arrives. If a size-determining signal arrives, the program proceeds to Step 405. At Step 405, the size is determined. Subsequently, it is determined whether the size determination is for the first sheet (Step 406). The aligning bar 26 is moved to the edge-aligning position 26*a* only in the case of the first sheet (Step 407), and the program proceeds to Step 408. At Step 408, a paper-discharging signal from the main body of the copier is awaited. If a paper-discharging signal arrives, the aligning bar 26 is moved to the waiting position 43*b* (Step 410). Subsequently, a conveying operation for discharging the sheets within the bins B is performed (Step 411), the aligning bar 26 is moved to the edge-aligning position 26*a* (Step 413), and the program proceeds to Step 414. At Step 414, it is determined whether or not a stapling signal is present. A stapling operation is performed only when a stapling signal is present (Step 415), and the program returns to the main routine.

The movement of the bins B in sorting will be further described later.

Figure 22:
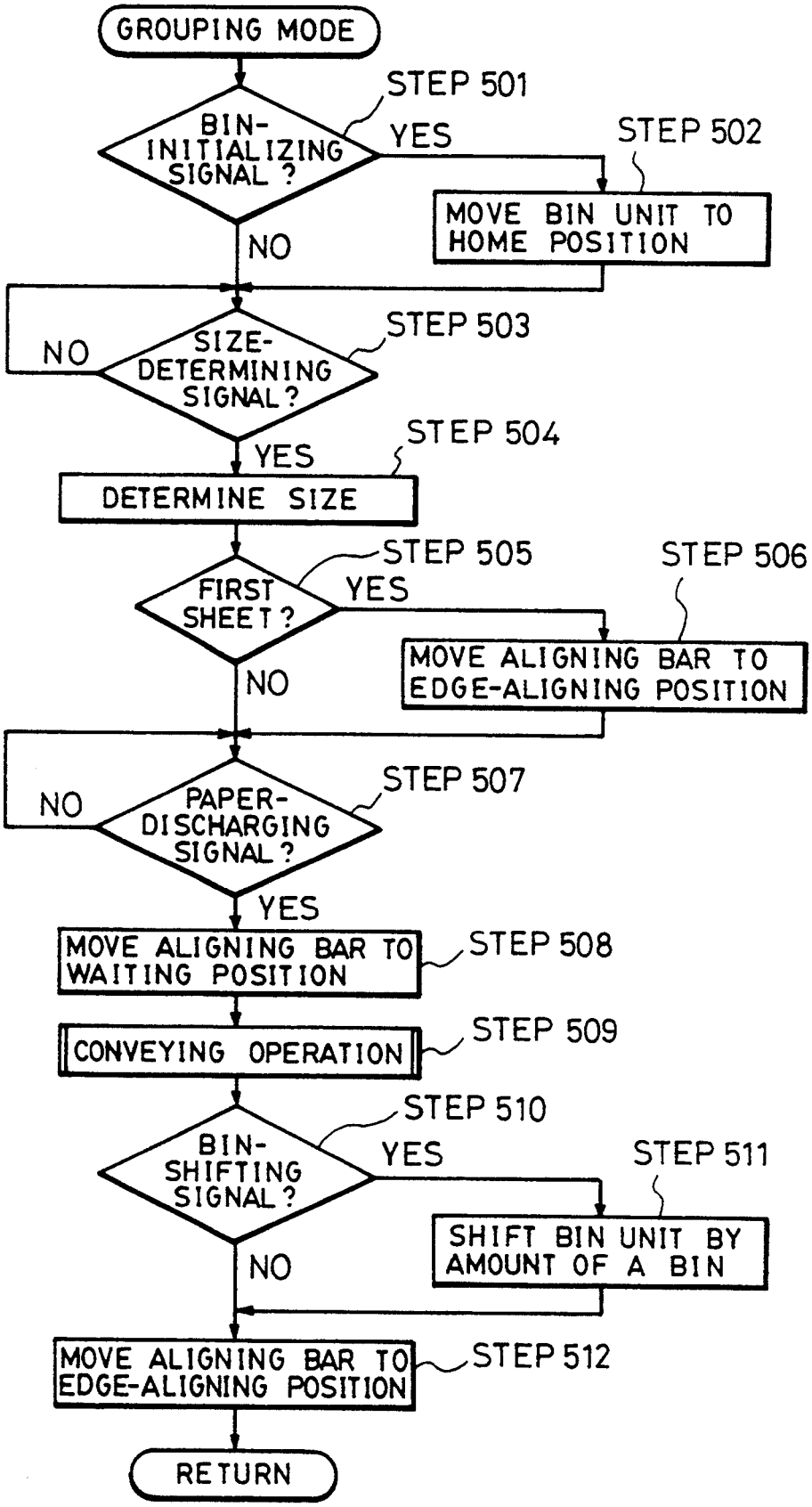

Next, the operation of the grouping mode will be explained with reference to FIG. 22.

First, it is determined whether or not a bin-initializing signal from the main body of the copier is present (Step 501). The bin unit 2 is moved to the home position only when a bin-initializing signal is present (Step 502). Subsequently, the program waits until a size-determining signal arrives (Step 503). If a size-determining signal arrives, the program proceeds to Step 504. At Step 504, the size is determined. Subsequently, it is determined whether the size determination is for the first sheet (Step 505). The aligning bar 26 is moved to the edge-aligning position 76*a* in the case of the first sheet (Step 506), and the program proceeds to Step 507. At Step 507, the program waits until a paper-discharging signal arrives. If a paper-discharging signal arrives, the program proceeds to Step 508. At Step 508, the aligning bar 26 is moved to the waiting position 26*b*. Subsequently, a conveying operation for conveying the sheet within the bin B is performed (Step 509). After the completion of the conveying operation, the program proceeds to Step 510. At Step 510, it is determined whether or not a bin-shifting signal from the main body of the copier is present. The bins B are shifted only when a bin-shifting signal is present (Step 511). After moving the aligning bar 26 to the edge-aligning position 26*a* in order to align the sheet (Step 512), the program returns to the main routine.

Figure 23:
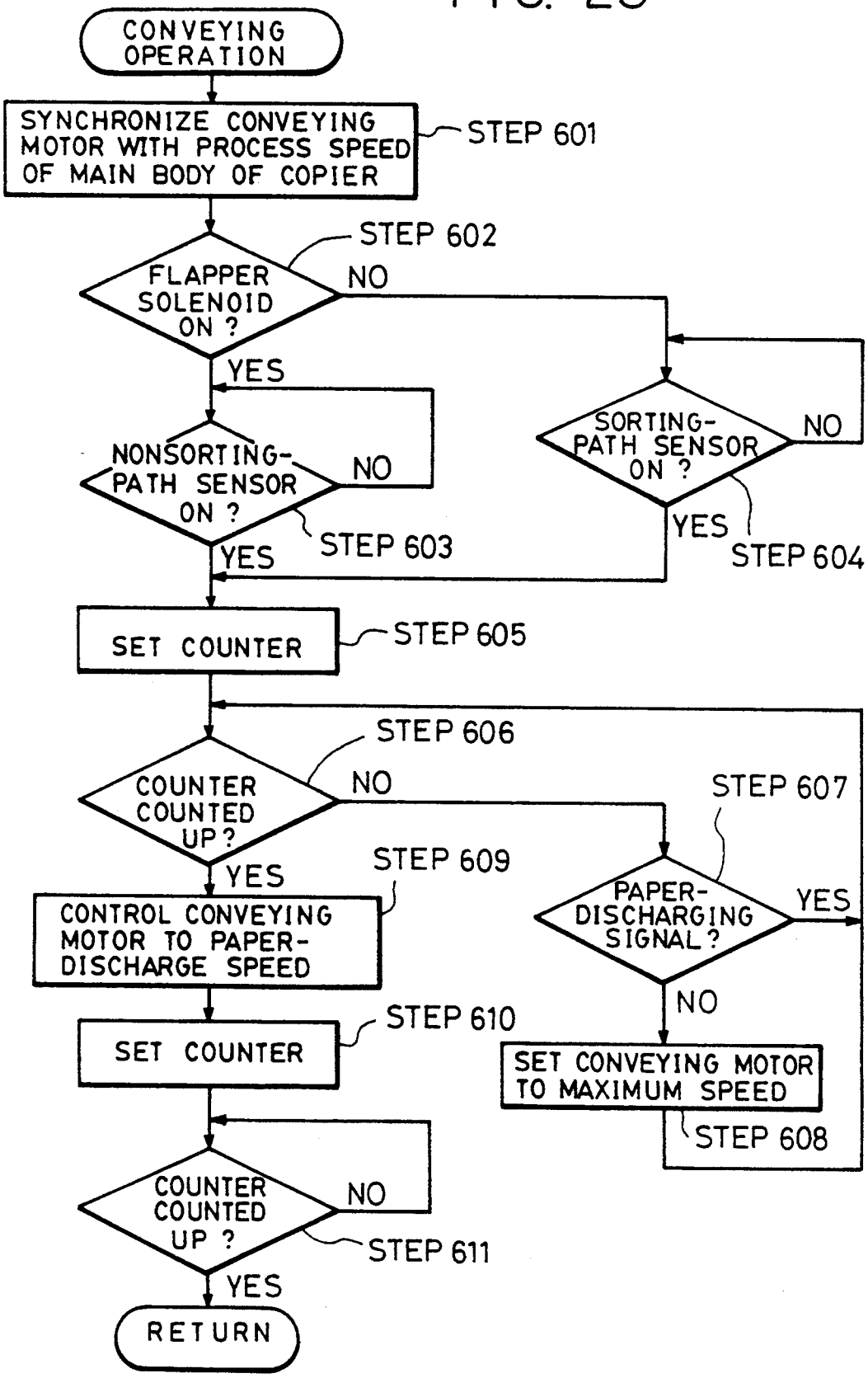

Next, the conveying operation will be explained with reference to FIG. 23.

In the conveying operation, when the sorter 1 receives a sheet from the main body of the copier, if the sheet conveying speed of the sorter 1 is slower than the sheet discharging speed of the main body of the copier, the sheet forms a loop between the sorter 1 and the copier, causing paper jamming. If the sheet conveying speed of the sorter 1 is faster than the sheet discharging speed of the main body of the copier, the sheet is pulled, providing a possibility of generating a strange sound or damaging the sheet. Accordingly, the conveying speed of the sorter 1 is synchronized with the process speed of the main body of the copier (Step 601). Subsequently, it is determined whether or not the flapper solenoid 122 is turned on, that is, which of the discharging outlet 16 for sorting and the discharging outlet 15 for nonsorting is selected (Step 602). If the flapper solenoid 122 is turned on, the discharging outlet 15 for nonsorting is selected. Hence, the program proceeds to Step 603, where the nonsorting-path sensor S1 performs detection. If the flapper solenoid 122 is turned off, the discharging outlet 16 for sorting is selected. Hence, the program proceeds to Step 604, where the sorting-path sensor S2 performs detection. At Steps 603 and 604, it is awaited until the nonsorting-path sensor S1 and the sorting-path sensor S2 are turned on, respectively, and the program proceeds to Step 605 after the sensors have been turned on. At Step 605, a counter for measuring a point to control the conveying motor 117 during paper-discharging is set. Subsequently, it is determined whether or not the counter set at Step 605 has completed its count (Step 606). If the result of the determination is affirmative, the program proceeds to Step 609. If the result of the determination is negative, the program proceeds to Step 607.

At Step 607, it is determined whether or not a paper-discharging signal from the main body of the copier is present. A sheet is deemed to have passed through the main body of the copier only when a paper-discharging signal is absent, and, in that case, the conveying speed is maximized (Step 608). Step 609 starts after it has been determined at Step 606 that the current point is the point to control the conveying motor 117 during paper-discharging, and controls the conveying motor 117 to the paper-discharging speed of the main body of the copier. Subsequently, a counter for measuring a point where paper discharging is completed is set (Step 610). If the counter has counted up, the operation is terminated (Step 611).

Figure 24:
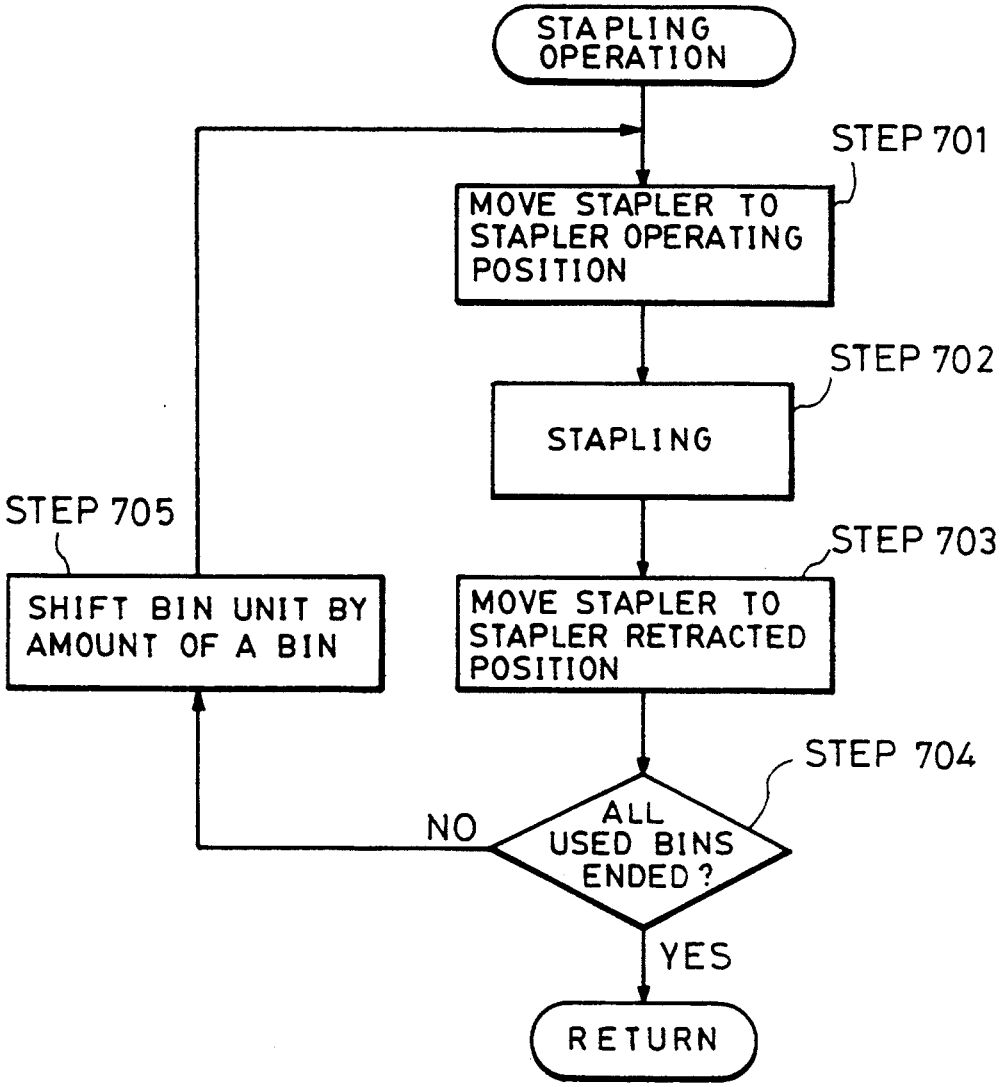

Next, the stapling operation will be explained with reference to FIG. 24.

First, at Step 701, the stapler swinging motor 119 is turned on in order to move the stapler 67. The stapler swinging motor 119 is driven until both the stapler-operating-position sensor S7 and the stapler positioning sensor S6 are turned on, that is, until the stapler 67 moves to the operating position *67a*. Subsequently, stapling is performed by driving the stapler motor 71. Stapling is performed after confirming that the stapler cam sensor S10 has been turned off until the stapler cam sensor S10 is turned on, that is, one stapling operation is completed by turning off the stapler motor 71 after performing one revolution (Step 702). Subsequently, the stapler swinging motor 119 is driven from the time period when the stapler-operating-position sensor S7 is turned off to the time period when the stapler positioning sensor S6 is turned on, that is, until the stapler 67 moves to the retracted position *67b* (Step 703). Subsequently, it is determined whether or not stapling of sheets in all the bins B has been completed (Step 704). If the result of the determination is negative, the bin unit 2 is shifted by an amount of one bin (Step 705), and the program proceeds to Step 701 in order to perform the next stapling operation. If the result of the determination is affirmative, the stapling operation is terminated.

Figure 25:
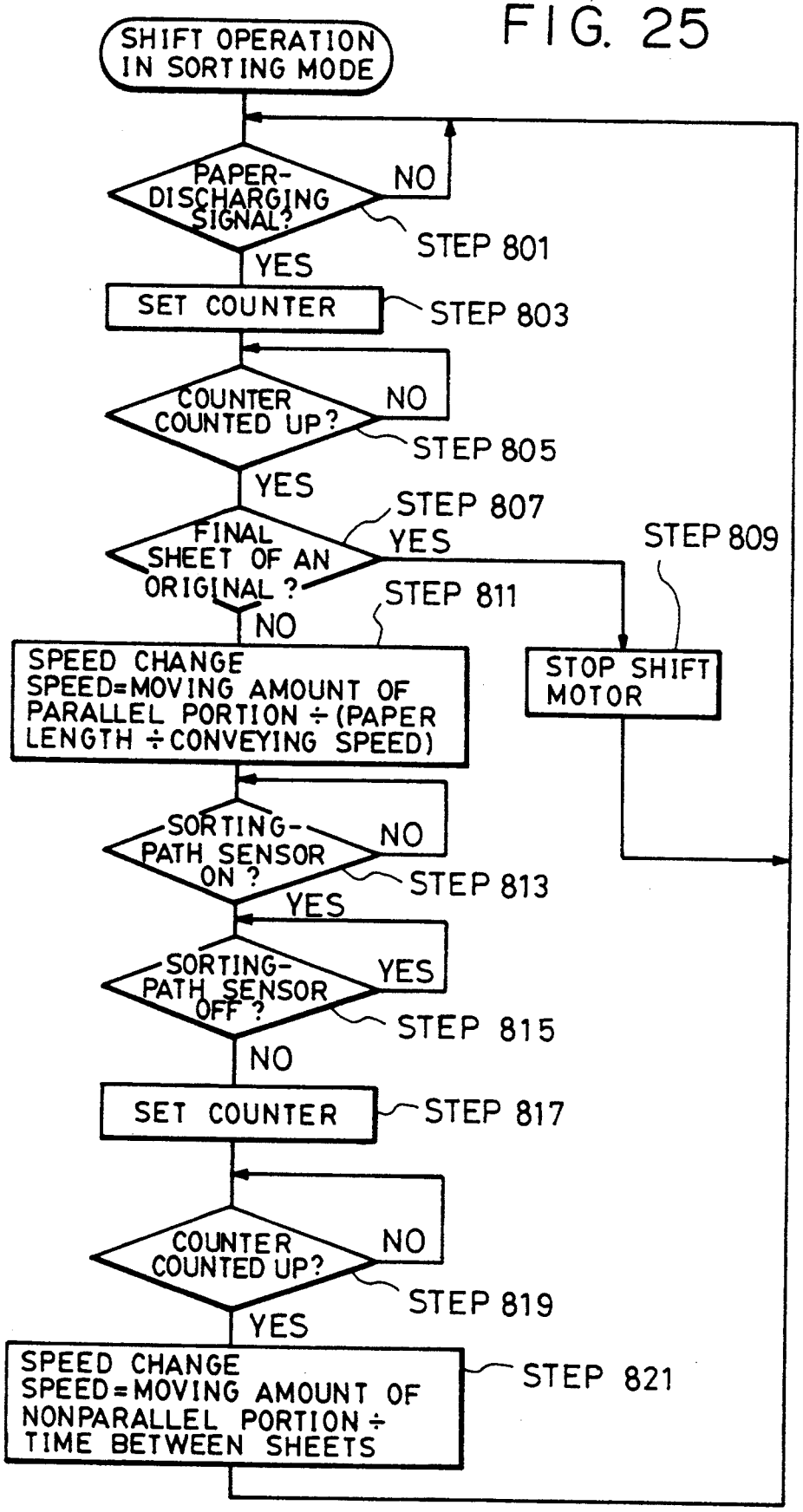

Next, the shifting operation in the sorting mode will be explained with reference to FIG. 25.

In the shifting operation in the sorting mode, first, in order to provide synchronization with the sheet P, a paper-discharging signal from the image forming apparatus is monitored (Step 801). If a paper-discharging signal arrives, a timing between the time period when the front end of the sheet P enters the bin B, and the end of the parallel portion of the lead cam 43 is arranged. More specifically, a counter for synchronization is set (Step 803), and when the counter has counted up (Step 805), the program proceeds to Step 807.

At Step 807, it is determined whether or not the transfer paper is the final sheet of the original. If the result of the determination is affirmative, since it is unnecessary to further advance the lead cam 43, the revolution of the lead cam 43 is stopped (Step 809).

If the result of the determination is negative, the program proceeds to Step 811, where the speed of the lead cam 43 is changed. The speed of the lead cam 43 at that time can be obtained by dividing the parallel portion of the lead cam 43 by a time represented by (paper length÷conveying speed). Data on the paper length is transmitted from the main body via serial communication shown in FIG. 17.

Subsequently, the program proceeds to Step 813, where, in order to recognize the rear end of the sheet P, it waits until the sorting-path sensor S2 is turned on, and then waits until the sorting-path sensor S2 is turned off (Step 815). Subsequently, after detecting the rear end of the sheet P by the turning-off of the sorting-path sensor S2, a counter for counting until the sheet P is received within the bins B is set (Step 817). If the counter has counted up (Step 819), the program proceeds to Step 821.

At Step 821, the shift speed is changed in accordance with a time interval between paper. The shift speed is obtained by (a moving amount of the nonparallel portion)÷(a time interval between paper). This time interval between paper is transmitted from the main body of the copier via serial communication. After determining the shift speed, the program returns to Step 801 in order to process the next sheet P.

Next, speed control of the shift motor 45 will be explained with reference to FIG. 26.

The control of the shift motor 45 is performed using a timer interruption function and a clock-signal interruption function of the CPU 111.

The timer interruption function is a function of generating an interruption with an arbitrary interval by a counter within the CPU 111. The clock signal interruption function is a function of generating an interruption by an edge of an external pulse. In the present control, the clock-signal sensor S13 provided in an encoder of the shift motor 45 is used in clock-signal interruption.

The control method comprises setting an interval of timer interruption to a time period of clock-signal interruption when the shift motor 45 reaches a target speed, providing an addition/subtraction counter for counting this ideal time period and clock-signal interruptions, and controlling so that the count value of the addition/subtraction counter becomes 0. Thus, an ideal speed is obtained.

Figure 26A:
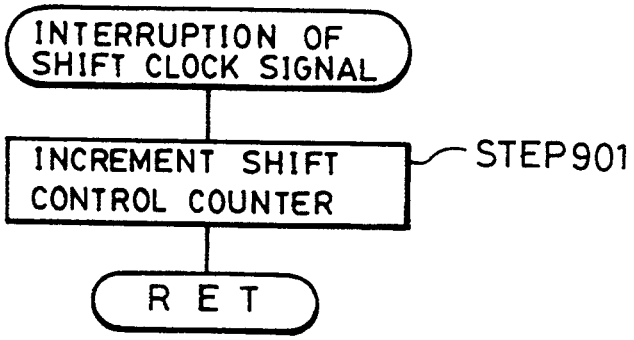
Figure 26B:
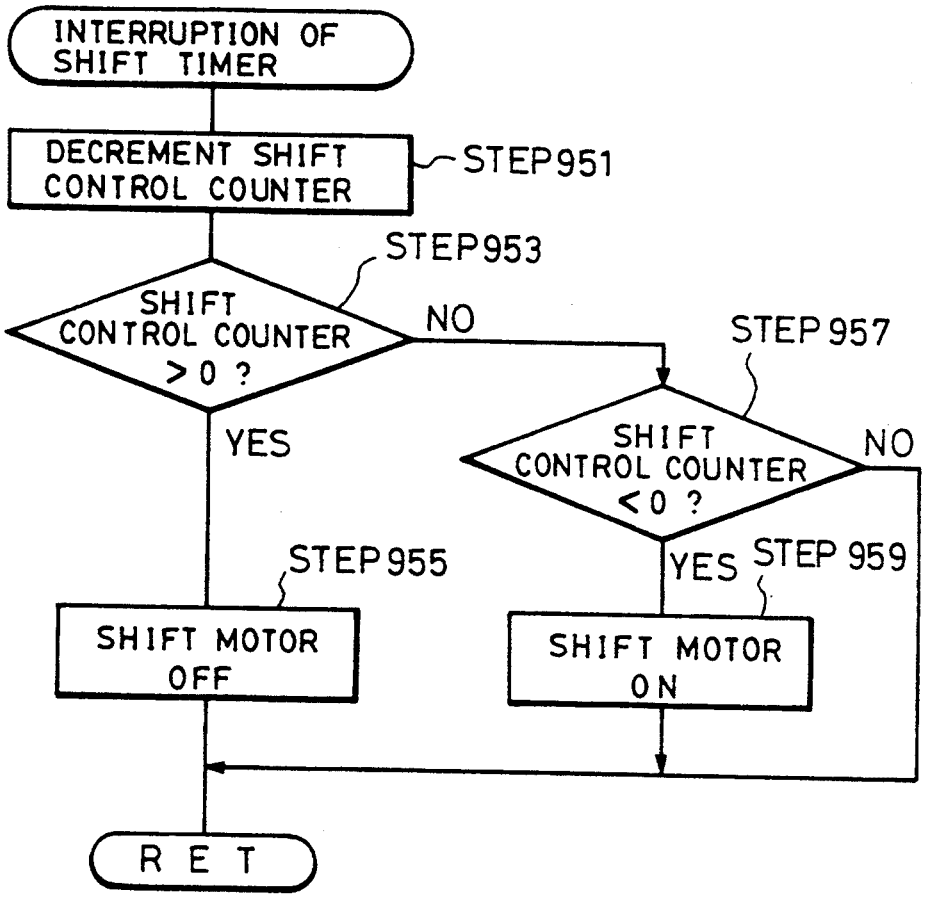

FIGS. 26(*a*) and 26(*b*) are specific flowcharts of the above-described control.

FIG. 26(*a*) shows clock-signal interruption processing. A count value of a shift control counter, serving as the addition/subtraction counter, is incremented. The shift control counter is provided within the RAM 113.

FIG. 26(*b*) shows timer interruption processing. In FIG. 26(*b*), first, a count value of the shift control counter is decremented (Step 951). Subsequently, it is determined whether the shift motor 45 is to be turned on or off. That is, it is determined whether or not the value of the shift control counter is greater than 0 (Step 953). If the result of the determination is affirmative, the shift motor 45 is turned off since it is too fast (Step 955). If the result of the determination is negative, it is determined whether or not the value is smaller than 0 at Step 957.

If the result of the determination is negative, the value of the shift control counter is 0, which indicates that the current speed equals the target speed. Hence, timer interruption is terminated. If the result of the determination is affirmative, the current speed is slower than the target speed. Hence, the shift motor 45 is turned on (Step 959), and timer interruption is terminated. As described above, the speed control of the motor 45 for moving the bin unit 2 up and down and expanding the bins B is performed.

Figure 33:
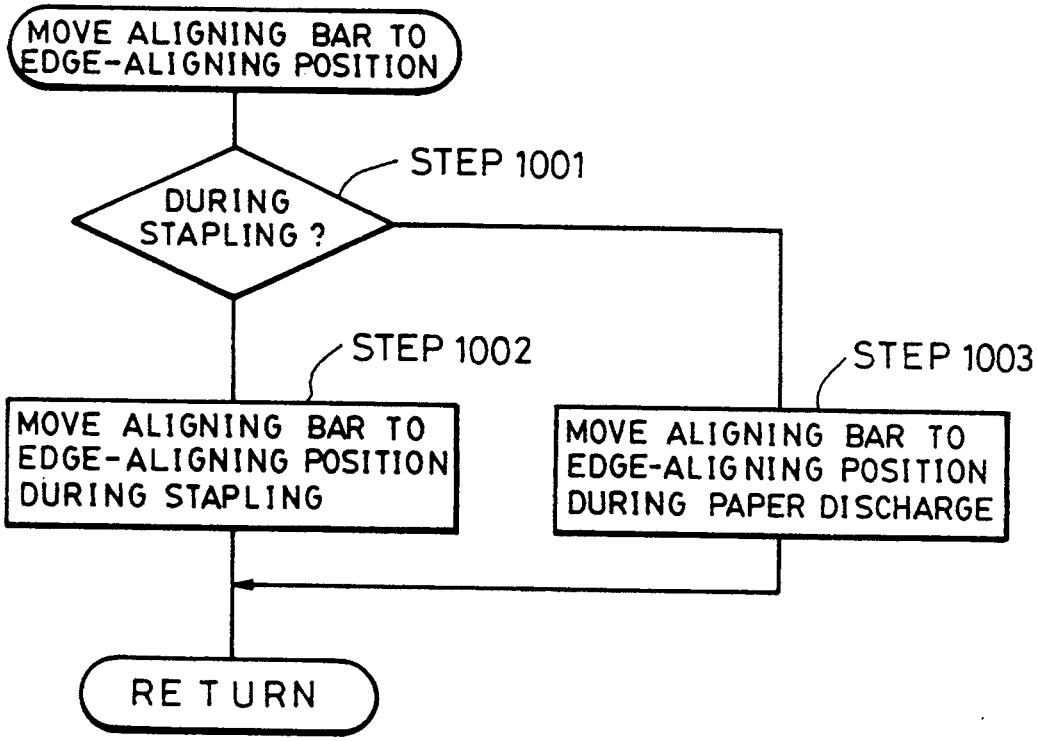
FIGS. 33(*a*) and 33(*b*) are flowcharts illustrating the operation of an aligning bar.
Figure 33:
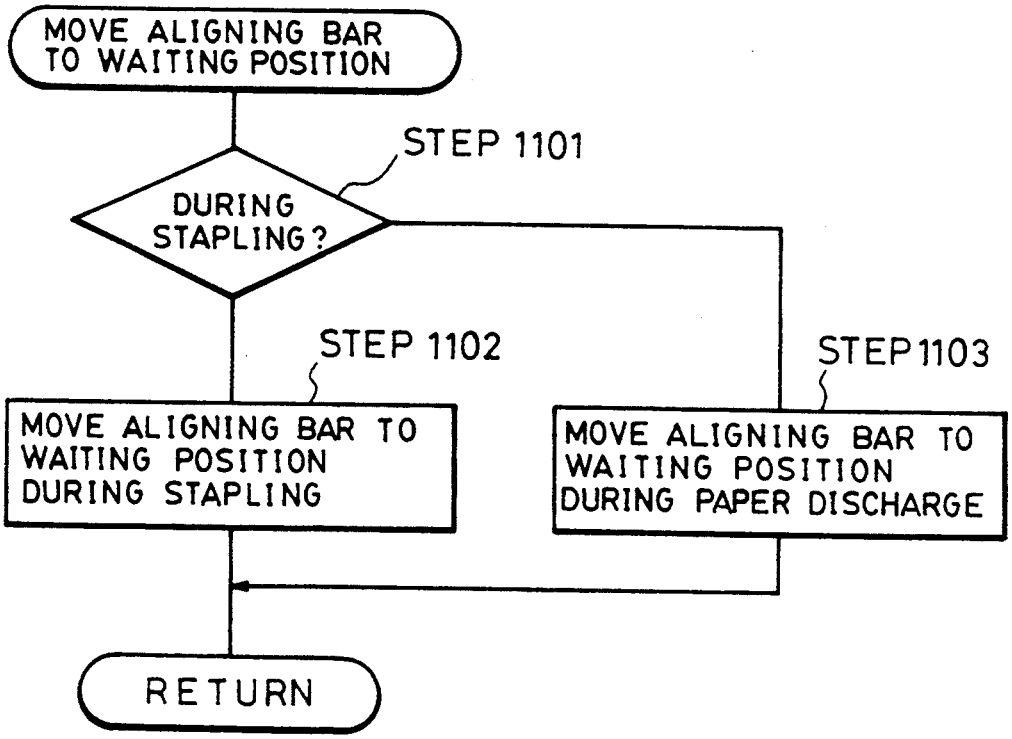

Next, the operation of the aligning bar 26 will be explained with reference to FIGS. 33(*a*) and 33(*b*).

When moving the aligning bar 26 to the edge-aligning position, it is determined whether or not the current process is taking place during stapling. If the result of the determination is affirmative, the program proceeds to Step 1002, where the aligning bar 26 is moved to the edge-aligning position during stapling. If the result of the determination is negative, the program proceeds to Step 1003, where the aligning bar 26 is moved to the edge-aligning position during paper discharge.

During stapling, since sheet alignment is performed in order to push against the paper bundle once aligned at paper discharge, it is only necessary to move the aligning bar 26 to the verge of the paper size. In paper discharge, however, it is necessary to push the aligning bar 26 to varying depths in order to obtain stable alignment. Respective aligning positions are set under such conditions, and are controlled to exact positions by a stepping motor 303 for alignment.

When moving the aligning bar 26 to the waiting position, at Step 1101, it is determined whether or not the current process is during stapling. If the result of the determination is affirmative, the program proceeds to Step 1102, where the aligning bar 26 is moved to the edge-aligning position during stapling. If the result of the determination is negative, the program proceeds to Step 1103, where the aligning bar 26 is moved to the edge-aligning position during paper discharge.

During paper discharge, the sheet P is separated from the aligning reference wall 23 during discharge. Hence, if it is intended to make the aligning bar 26 wait at a position not interfering with the sheet P, the aligning bar 26 must be greatly retracted. During stapling, however, since the sheets P are in a state of contacting the aligning reference wall 23 after being once aligned, the aligning bar 26 need not be greatly retracted. Hence, the moving amount of the aligning bar 26 is reduced in order to speed up aligning process. The aligning bar 26 for aligning the sheets P is controlled in the above-described manner.

Although, in the above-described embodiment, disturbance in stapling positions by the stapler 67 is prevented by making the pushing force of the aligning bar 26 while the stapling unit operates smaller than the pushing force of the aligning bar 26 while the sheet P is aligned, the same effect may be obtained, for example, by pushing the aligning bar 26 against the end portion of the sheet only while the stapler 67 moves from the retracted position 67X to the sheet stapling position 67Y when the stapling unit enters the sheet region, and by retracting the aligning bar 26 from the end portion of the sheet immediately before the stapler 67 operates during stapling.

In the present embodiment, if the door 96 near the stapler 67 is opened when the reflection-type staple sensor 93 within the stapler 67 has detected absence of staples, the stapler 67 is moved to the sheet stapling position 67Y. At that time, the interlocking arm 91 is released by the actuator plate 92, and the staple cartridge 69 can be detached. However, it is also possible to electrically operate the interlocking arm 91 by the drive of a solenoid means, a motor or the like.

Alternatively, a magnetic substance may be disposed near the staple cartridge 69, which may be held by a magnetic force of an electromagnet disposed near the staple cartridge 69, and locking of the staple cartridge 69 may be released by disconnecting current supply for the electromagnet in accordance with a staple-absent signal.

Figure 34:
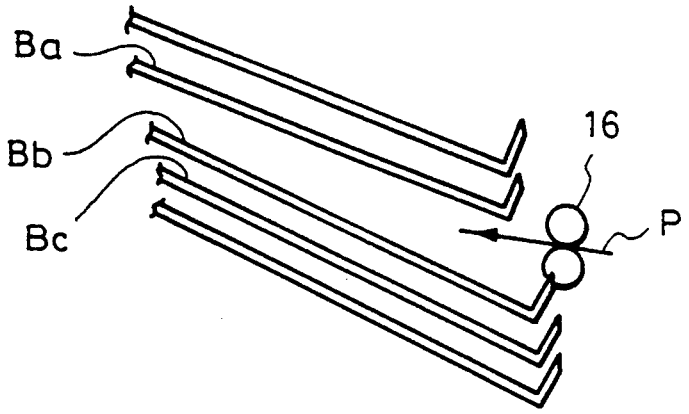
FIGS. 34(*a*) and 34(*b*) are side views illustrating another embodiment of an opening operation of bins.
Figure 34:
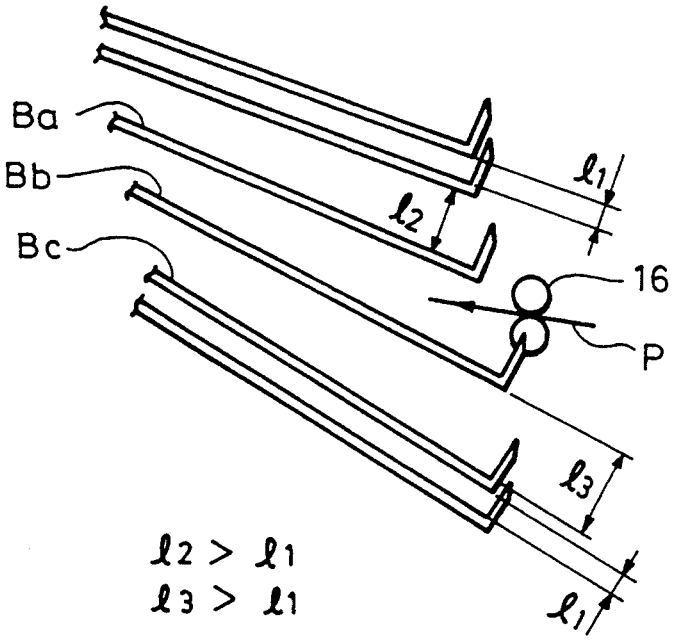

In the above-described embodiment, an explanation has been provided of the configuration wherein the paper-discharged bin and the lower adjacent bin are open. However, the same effect may be obtained if, for example, as shown in FIG. 34(*a*), in a sorter wherein only the position of the paper-discharged bin is opened, alignment of the sheets P is completed before the upper bin $B_a$ completes its descent. As shown in FIG. 34(*b*), when the opened amount of the paper-discharged bin $B_b$ and the upper adjacent bin $B_a$ is large, alignment of the sheet P may be performed after the completion of a shifting-up movement.

That is, it is possible to increase the number of sheets P which can be mounted and aligned within the bin, and accuracy of alignment by adopting the configuration wherein alignment of the sheets P is performed when the bin is greatly opened so that the sheets P mounted on the bin are not disturbed by a high-speed force due to the alignment.

In FIG. 34(*b*), a relationship of $\iota_2 > \iota_1$ and $\iota_3 > \iota_1$ is satisfied, where $\iota_1$ represents a normal interval between bins, $\iota_2$ represents an interval between the upper adjacent bin $B_a$ of the paper-discharged bin $B_b$ and the upper adjacent bin of the bin $B_a$, and $\iota_3$ represents an interval between the paper-discharged bin $B_b$ and the lower adjacent bin $B_c$ of the bin $B_b$.

While the present invention has been described with respect to what is presently considered to be the preferred embodiments, it is to be understood that the invention is not limited to the disclosed embodiments. The present invention is intended to cover the various modifications and equivalent arrangements included within the spirit and scope of the appended claims.

What is claimed is:

1. A sheet sorter comprising:

a plurality of bins for receiving sorted sheets;

sheet discharging means for discharging sheets to said bins;

shifting means for selectively raising or lowering said plurality of bins in order to selectively align an opening of one of said plurality of bins with said sheet discharging means;

a first aligning member for regulating a side portion of a sheet discharged into said one bin; and a second aligning member for bringing said side portion of the discharged sheet into contact with said first aligning member by pushing against an opposing side portion of the sheet;

where said sheet sorter further comprises:

control means for variably controlling said second aligning member so as to start alignment of a discharged sheet at one timing after receiving the discharged sheet during a first sorting mode wherein the shifting means raises a bin receiving the discharged sheet after receiving the discharged sheet, and at a second timing after receiving the discharged sheet during a second sorting mode wherein the shifting means lower a bin receiving the discharged sheet after receiving the discharged sheet.

2. A sheet sorter comprising:

a plurality of bins for receiving sorted sheets;

sheet discharging means for discharging sheets to said bins;

shifting means for raising and lowering said plurality of bins in order to selectively align an opening of one of said plurality of bins with said sheet discharging means;

a first aligning member for regulating a side portion of a sheet discharged into said bin; and a second aligning member for bringing said side portion of the sheet into contact with said first aligning member by pushing against an opposing side portion of the sheet;

wherein said sheet sorter further comprises:

control means for variably controlling said second aligning member so as to start alignment of the sheet at one timing during first mode sorting wherein the bin receiving the discharged sheet rises after receiving the sheet and at a second timing during second mode sorting wherein the bin receiving the sheet descends after receiving the sheet;

wherein during first mode sorting said control means controls in a manner whereby the second aligning member pushes the sheet against the first aligning member before the bin completes its upward shift.

3. A sheet sorter according to claim 2, wherein the bin is inclined so that an end of said bin facing the sheet discharging means is lowered, and the bin includes a stopper at said side end facing the sheet discharging means for suppressing switchback, and wherein the control means initiates pushing of the second aligning member while the bin rises.

4. A sheet sorter according to claim 3, further comprising means for widening an interval between bins as the bin rises, and wherein the interval between bins at the end facing the sheet discharging means is greater than the interval between bins of an end opposite to the end facing the sheet discharging means.

5. A sheet sorter according to claim 2, wherein during second mode sorting the control means controls in a manner whereby the second aligning member pushes the sheet against the first aligning member after the bin has completed a downward shift.

6. A sheet sorter according to claim 5, wherein the bin is inclined so that an end of said bin facing the sheet discharging means is lowered, and the bin includes a stopper at said side facing the sheet discharging means for suppressing switchback, and wherein the control means initiates pushing of the second aligning member after the bin has completed a downward shift.

7. A sheet sorter according to claim 3 or 6, wherein, when the bin facing the sheet discharging means shifts up, the bin also slides in a sheet discharging direction.

8. A sheet sorter according to claim 3 or 6, wherein the second aligning member is configured so as to extend in a mounting direction of the bins.

9. A sheet sorter comprising:

a plurality of bins for receiving sorted sheets;

sheet discharging means for discharging sheets to said bins;

shifting means for raising and lowering said plurality of bins in order to selectively align an opening of one of said bins with said sheet discharging means;

a first aligning member for regulating a side portion of a sheet discharged into said bin; and a second aligning member for bringing said side portion of the sheet into contact with said first aligning member by pushing against an opposing side portion of the sheet;

wherein said sheet sorter further comprises:

control means for controlling said second aligning member so that the second aligning member pushes the sheet against the first aligning member before the bin completes its upward shift during first mode sorting wherein the bin receiving the sheet rises after receiving the sheet, and so that the second aligning member pushes the sheet against the first aligning member after the bin has completed its downward shift during second mode sorting wherein the bin receiving the sheet descends after receiving the sheet.

10. An image forming apparatus including a sheet sorter comprising:

image forming means for forming images on sheets;

a plurality of bins for receiving sorted sheets;

sheet discharging means for discharging sheets with images formed thereon to said bins;

shifting means for selectively raising or lowering said plurality of bins in order to selectively align an opening of one of said plurality of bins with said sheet discharging means;

a first aligning member for regulating a side portion of a sheet discharged into said one bin; and a second aligning member for bringing said side portion of the discharged sheet into contact with said first aligning member by pushing against an opposing side portion of the sheet;

wherein said image forming apparatus including the sheet sorter further comprises;

control means for variably controlling said second aligning member so as to start alignment of a discharged sheet at one timing after receiving the discharged sheet during a first sorting mode wherein the shifting means raises a bin receiving the discharged sheet after receiving the discharged sheet, and at a second timing after receiving the discharged sheet during a second sorting mode wherein the shifting means lower a bin receiving the discharged sheet after receiving the discharged sheet.

11. An image forming apparatus including a sheet sorter comprising:

image forming means for forming images on sheets;

a plurality of bins for receiving sorted sheets having images formed thereon;

sheet discharging means for discharging the sheets with images formed thereon to said bins;

shifting means for raising and lowering said plurality of bins in order to selectively align an opening of one of said plurality of bins with said sheet discharging means;

a first aligning member for regulating a side portion of a sheet discharged into said bin; and a second aligning member for bringing said side portion of the sheet into contact with said first aligning member by pushing against an opposing side portion of the sheet;

wherein said image forming apparatus including the sheet sorter further comprises:

control means for controlling said second aligning member so that the second aligning member pushes the sheet against the first aligning member before the bin completes its upward shift during first mode sorting wherein the bin receiving the sheet rises after receiving the sheet, and so that the second aligning member pushes the sheet against the first aligning member after the bin has completed its downward shift during second mode sorting wherein the bin receiving the sheet descends after receiving the sheet.

12. An image forming apparatus including a sheet sorter comprising:

image forming means for forming images on sheets;

a plurality of bins for receiving sorted sheets;

sheet discharging means for discharging sheets to said bins;

shifting means for raising and lowering said plurality of bins in order to selectively align an opening of one of said plurality of bins with said sheet discharging means;

a first aligning member for regulating a side portion of a sheet discharged into said bin; and a second aligning member for bringing said side portion of the sheet into contact with said first aligning member by pushing against an opposing side portion of the sheet;

wherein said sheet sorter further comprises:

control means for variably controlling said second aligning member so as to start alignment of the sheet at one timing during first mode sorting wherein the bin receiving the discharged sheet rises after receiving the sheet and at a second timing during second mode sorting wherein the bin receiving the sheet descends after receiving the sheet;

wherein during first mode sorting said control means controls in a manner whereby the second aligning member pushes the sheet against the first aligning member before the bin completes its upward shift.

* * * * *

UNITED STATES PATENT AND TRADEMARK OFFICE

CERTIFICATE OF CORRECTION

PATENT NO. : 5,345,303

DATED : September 6, 1994

INVENTOR(S) : MASAKAZU HIROI, ET AL.

It is certified that error appears in the above-indentified patent and that said Letters Patent is hereby corrected as shown below:

Column 3,
line 67, "tile" should read --the--.

Column 7,
line 68, "a" should read --an--.

Column 11,
line 41, "will" should read --will be--.

Column 12,
line 39, "$\theta_1$" should read --$\theta$--.

Column 13,
line 14, "be" should be deleted.

Column 16,
line 13, "$B_b$so" shold read --$B_b$ so--.

UNITED STATES PATENT AND TRADEMARK OFFICE

CERTIFICATE OF CORRECTION

PATENT NO. : 5,345,303

DATED : September 6, 1994

INVENTOR(S) : MASAKAZU HIROI, ET AL.

It is certified that error appears in the above-indentified patent and that said Letters Patent is hereby corrected as shown below:

Column 18,
line 58, "un" should read --on--.
Column 22,
line 4, "copys-" should read --copy--; and
line 5, "tart" should read --start--.
Column 28,
line 54, "lower" should read --lowers--.
Column 30,
line 30, "lower" should read --lowers--.

Signed and Sealed this

Fourth Day of April, 1995

Bruce Lehman

*Attest:*

BRUCE LEHMAN

*Attesting Officer*

*Commissioner of Patents and Trademarks*